US006321670B1

(12) United States Patent
Tomita et al.

(10) Patent No.: US 6,321,670 B1
(45) Date of Patent: Nov. 27, 2001

(54) DISPLAY APPARATUS AND DISPLAY CONTROLLING METHOD FOR A SEWING MACHINE

(75) Inventors: Shintaro Tomita; Naomi Yamamoto, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/597,277

(22) Filed: Jun. 19, 2000

(30) Foreign Application Priority Data

Jun. 22, 1999 (JP) ..... 11-175687

(51) Int. Cl.[7] ..... D05B 19/12; D05C 5/02

(52) U.S. Cl. ..... 112/475.19; 112/102.5; 112/445; 112/458; 112/470.04

(58) Field of Search ..... 112/475.19, 102.5, 112/470.04, 470.06, 445, 454, 456, 457, 458; 700/138, 136, 137

(56) References Cited

U.S. PATENT DOCUMENTS

| | | | | |
|---|---|---|---|---|
| 4,341,170 | * | 7/1982 | Beckerman et al. | 112/445 |
| 4,860,678 | * | 8/1989 | Skogward | 112/445 |
| 5,029,539 | * | 7/1991 | Yokoe et al. | 112/454 X |
| 5,740,057 | * | 4/1998 | Futamura | 112/102.5 X |
| 6,032,596 | * | 3/2000 | Hayakawa | 112/102.5 |
| 6,167,822 | | 1/2001 | Miyasako et al. . | |

* cited by examiner

*Primary Examiner*—Peter Nerbun
(74) *Attorney, Agent, or Firm*—Oliff & Berridge, PLC

(57) ABSTRACT

In a sewing machine, a plurality of patterns are displayed on a pattern selection area of a display. Then, when one of the patterns displayed on the pattern selection area is selected, the selected pattern is displayed in a realistic manner on a pattern display area on the display. At this time, at least a part of the pattern display area is displayed while the pattern selection area is displayed. Therefore, the operator can see and grasp the pattern with a realistic image through the pattern display area while selecting the pattern.

30 Claims, 19 Drawing Sheets

DISPLAY APPARATUS AND DISPLAY CONTROLLING METHOD FOR A SEWING MACHINE

BACKGROUND OF THE INVENTION

1. Field of Invention

The invention relates to a display apparatus for a sewing machine with a pattern sewing or forming function for displaying a pattern selection area, in which a plurality of patterns can remain displayed and a pattern can be selected therefrom, and a pattern display area, in which a selected pattern can be displayed and edited, on the same screen during the selection of the pattern.

2. Description of Related Art

Conventionally, a sewing machine with an embroidery function has a sewing mechanism for forming stitches by driving a needle bar, a thread take-up, and a rotary hook, and an embroidery frame driving mechanism that moves and drives an embroidery frame in crosswise directions independently. A controller controls and actuates the sewing mechanism and the embroidery frame driving mechanism based on sewing data (including sets of stitch data) for an embroidery pattern, to embroider the pattern on a work cloth set in the embroidery frame.

The sewing machine basically pre-stores pattern data (including sewing data) for embroidery patterns in a ROM of the controller and a ROM card that is detachably inserted into the controller. A pattern (or pattern data) selected from the embroidery patterns stored can be edited before embroidering, such as repositioning, magnifying/reducing, and mirroring.

A sewing machine with embroidery function, having a display and plural touch keys representing various functions through the display, is structured to display a pattern selection screen on the display when selecting an embroidery pattern, and a pattern edit screen on the display when editing the selected embroidery pattern.

On the pattern selection screen, a plurality of embroidery patterns (character patterns and picture patterns) are displayed in a pattern selection area that accounts for the most part of the display. A desired embroidery pattern is selected with a touch of the display as a pattern to be used with embroidering. When a character pattern is selected, the selected character pattern is displayed in an area except for the pattern selection area of the pattern selection screen, for confirmation.

After the pattern is selected, the pattern selection screen is switched to the pattern edit screen. On the pattern edit screen, the selected pattern is displayed in the pattern display area (corresponding to a size of the embroidery frame in which embroidery is available), so that it can be edited with a touch of pattern edit keys such as eight direction keys.

In the conventional sewing machine with embroidery function, especially when a character pattern is selected, it is displayed in an area outside of the pattern selection area of the pattern selection screen. However, as the area is very small, an operator can only confirm the selected character pattern. The operator can not see and grasp the layout of the pattern such as the size and the orientation of the pattern and the array orientation of the pattern especially consisting of a plurality characters.

Therefore, it is not until the selected character pattern is displayed in the pattern display area on the pattern edit screen that the operator can see and grasp the layout of the pattern. Because the operator can not grasp the layout when selecting a character, the operator is likely to change the character pattern when the layout is displayed on the pattern edit screen after the character selection. In this case, it is necessary to change the display from the pattern edit screen to the pattern selection screen again for re-selection of a character pattern, which is very troublesome.

In a conventional sewing machine, the pattern size and the array orientation are set in advance, and a character pattern for embroidery is selected. However, the pattern size and the array orientation are not yet seen on the display when the pattern is selected, therefore, the similar problem still exists, and the preset information on the pattern size and the array orientation does not function effectively.

SUMMARY OF THE INVENTION

The invention provides a display apparatus for a sewing machine with a pattern sewing or forming function, in which a display can show at least a part of a pattern selection area and a pattern display area simultaneously when a pattern is selected, so that an operator can see and grasp the size and orientation of the pattern and the orientation of the character string when a plurality of character patterns are selected, in the pattern display area.

In this regard, the display apparatus for a sewing machine of the invention may include a display, a pattern selection area controller that displays a pattern selection area on the display, the pattern selection area controller displaying at least one pattern on the pattern selection area, a selection device that selects the pattern displayed on the pattern selection area, a pattern display area controller that displays a pattern display area on the display, the pattern display area controller displaying the selected pattern in a realistic manner on the pattern display area, and a display controller that controls the display to display at least a part of the pattern display area while the pattern selection area is displayed.

According to the display apparatus structured as described above, a selection device selects the pattern displayed on the pattern selection area, a pattern display area controller displays a pattern display area on the display, the pattern display area controller displays the selected pattern in a realistic manner on the pattern display area, and a display controller controls the display to display at least a part of the pattern display area while the pattern selection area is displayed. Therefore, the operator can see and grasp the pattern with a realistic image through the pattern display area while selecting the pattern.

In an exemplary embodiment of the invention, the display apparatus may further include an edit device that edits the pattern displayed on the pattern display area. Therefore, the operator can see the pattern to be edited before editing it while selecting the pattern.

In another exemplary embodiment of the invention, the realistic manner may be related to at least one of pattern size, pattern orientation, or arrangement orientation. Therefore, the operator can recognize pattern size, pattern orientation, or arrangement orientation of the selected pattern.

In another exemplary embodiment of the invention, the display may include a touch key panel including at least one touch key, and the selection device may include the touch key. Therefore, the operator can select the desired pattern using the touch key in a simple manner.

In another exemplary embodiment of the invention, the display controller may control the display to display the pattern selection area and the pattern display area without overlapping each other. According to the display apparatus structured as described above, the whole pattern selection area and the whole pattern display area can be displayed on the same screen of the display. Therefore, the operator can recognize the whole selected pattern with a realistic image without interfering with the selection of the pattern.

In another exemplary embodiment of the invention, the display controller controls the display to display the pattern selection area overlapping a part of the pattern display area, and the pattern display area controller displays at least a portion of the pattern on an un-overlapped part of the pattern display area, where the pattern selection area is not overlapped. Therefore, the operator can recognize the selected pattern with a realistic image without interfering with the selection of the pattern. Further, the space of the display can be used efficiently.

In another exemplary embodiment of the invention, when a character pattern is selected by the selection device, the whole character pattern can be displayed on the un-overlapped part of the pattern display area. According to the display apparatus structured as described above, the content of the whole character pattern can be recognized by the operator.

In another exemplary embodiment of the invention, when selection of the pattern is completed, the display controller may control the display to cancel displaying the pattern selection area. In addition, the pattern display area controller may display the selected pattern in a substantially center portion of the pattern display area. Therefore, after selection of the pattern is completed, the whole selected pattern display area is displayed. Further, the selected pattern is displayed very clearly at a substantially center portion of the pattern display area.

In another exemplary embodiment of the invention, the display controller may control the display to display information on a remaining part of the display except for the pattern selection area and the pattern display area. Therefore, the remaining part of the display can be used efficiently by displaying various kinds of information thereon.

BRIEF DESCRIPTION OF THE DRAWINGS

Various exemplary embodiments of the invention will be described in greater detail with reference to the accompanying drawings wherein.

DETAILED DESCRIPTION OF PREFERRED EMBODIMENTS

Various exemplary embodiments of the invention will be described in detail with reference to the accompanying drawings.

Various exemplary embodiments of the invention will be described embodied in an electronically controlled sewing machine having a detachable embroidery frame driving device (embroidery device) that enables embroidery of various patterns. Although the invention is described in relation to an electronically controlled sewing machine having an embroidery device, it should be appreciated that the invention is applicable to an electronically controlled sewing machine including a pattern sewing or forming device for forming a pattern or patterns, for example, a button hole, using, for example, utility stitching or zigzag stitching.

Figure 1:
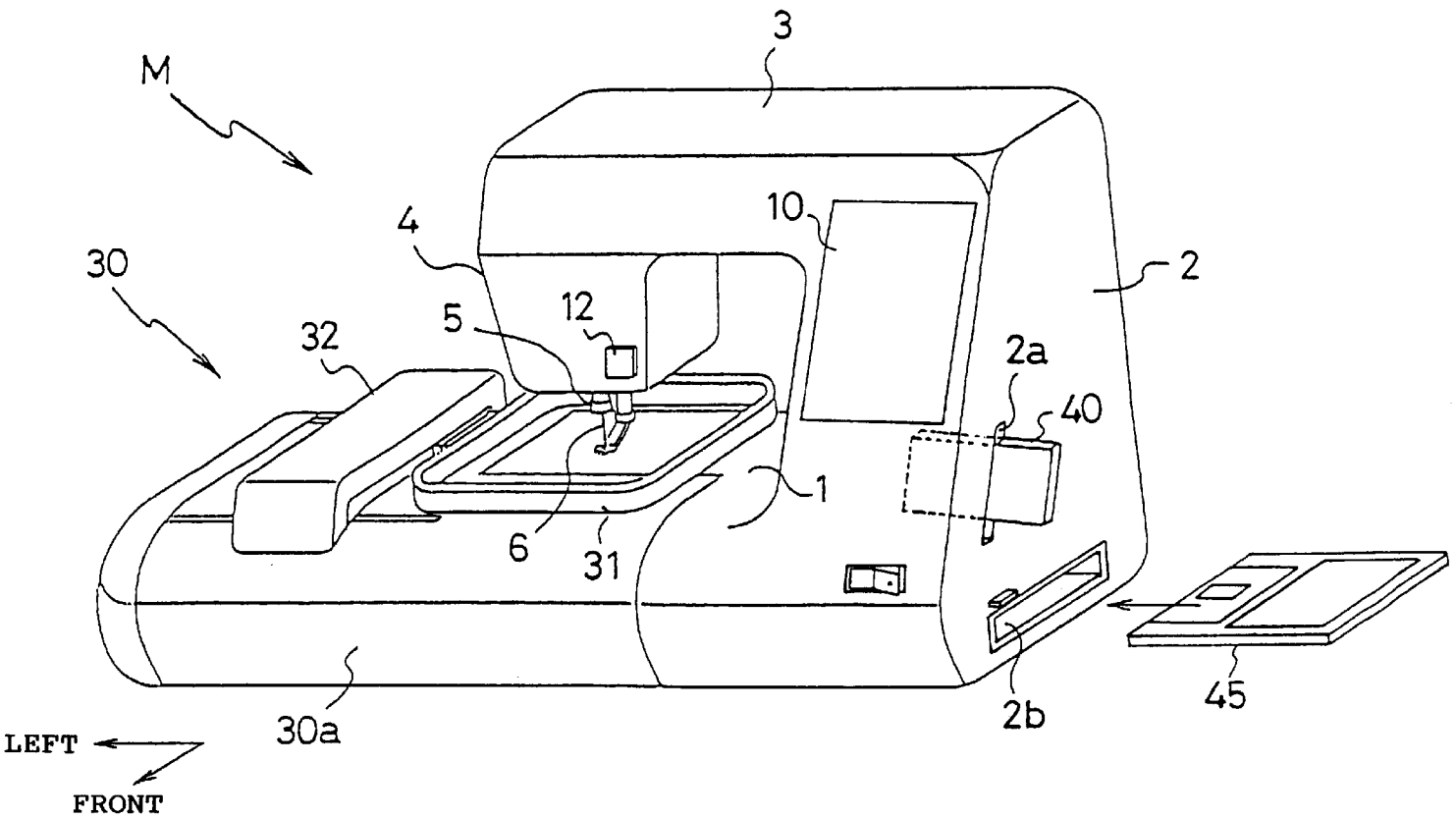
FIG. 1 is a perspective view of an exemplary embodiment of an electronically controlled sewing machine according to the invention.

As shown in FIG. 1, an electronically controlled sewing machine M has a bed 1, a standard portion 2 that stands on the bed 1, an arm 3 extending from the upper part of the standard portion 2 so as to face the bed 1.

The bed 1 includes a feed dog, a feed dog up and down moving mechanism (not shown) that moves the feed dog up and down, a feed dog back and forth moving mechanism (not shown) that moves the feed dog back and forth, and a thread loop taker (e.g. a vertical axis oscillating shuttle) that contains a lower thread bobbin and incorporates with a needle 6 that moves up and down to make a stitch. An embroidery frame driving device 30 is detachably fixed to a free bed, generally known as a free arm, of the bed 1.

Figure 2:
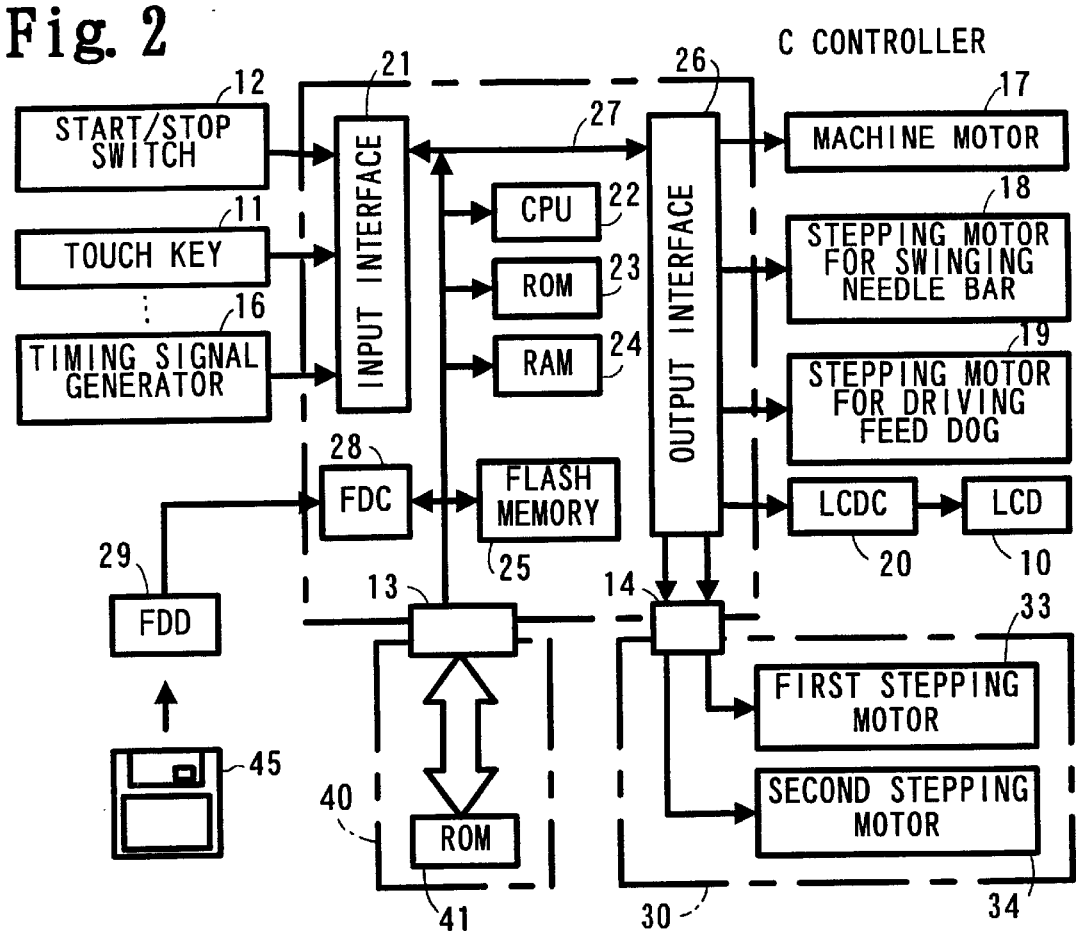
FIG. 2 is an exemplary embodiment of a control block diagram of the electronically controlled sewing machine according to the invention.

On the side of the standard portion 2, there is a slot 2*a* in which a memory card 40, for example, a ROM card, having a large amount of embroidery pattern data is connected to an internal connector 13 (refer to FIG. 2). A floppy disk drive (FDD) 29 (refer to FIG. 2) is provided inside under the slot 2*a*, with a disk slot 2*b* in which a floppy disk 45 is inserted.

The arm 3 includes a needle bar driving mechanism (not shown) that moves a needle bar 5 having the needle 6 at the bottom up and down, a needle bar swinging mechanism (not shown) that swings the needle bar 5 in the direction perpendicular to a feed direction of a work cloth, and a thread take-up driving mechanism (not shown) that moves a thread take-up in accordance with the up and down movement of the needle bar 5. A start/stop switch 12 that orders the start and stop of sewing operation is provided on the front of the head 4 of the arm 3. The feed dog moving up and down mechanism, the needle bar driving mechanism, and the thread take-up driving mechanism are driven by a machine motor 17. The needle bar swinging mechanism is driven by a stepping motor 18 for swinging the needle bar. The feed dog back and forth driving mechanism is driven by a stepping motor 19 for moving the feed dog back and forth (refer to FIG. 2).

Figure 4:
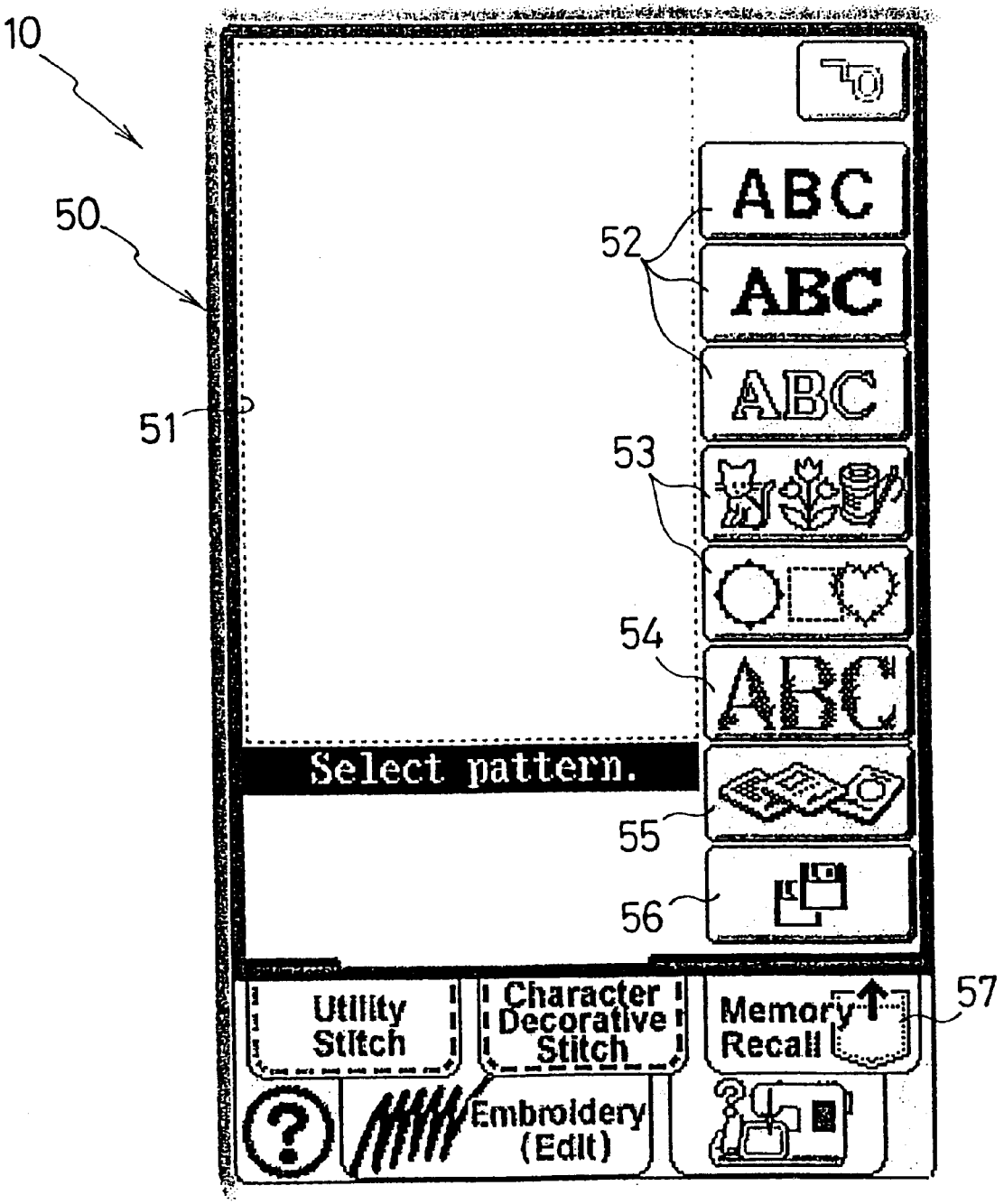
FIG. 4 is an exemplary embodiment of a pattern type selection screen displayed on a display.

On the front of the standard portion 2, a display 10, such as a color liquid crystal display (LCD) is provided in a portrait orientation. The LCD 10 is designed to display various screens according to circumstances: such as a pattern type selection screen 50 shown in FIGS. 4 and 9, a character selection screen 60 shown in FIGS. 5 and 6, a pattern selection screen 80 shown in FIG. 10, a pattern edit screen 70 shown in FIGS. 7, 8, and 11, and a sewing information screen shown in FIGS. 12 and 13.

The LCD 10 has a plurality of touch keys 11 (FIG. 2) which are transparent electrodes placed in a matrix thereon. Selection of a desired embroidery pattern or an order of a function can be realized simply by pressing a corresponding touch key 11.

The embroidery frame driving device 30 includes a casing 30*a*, an embroidery frame 31, or other work holder, that holds a work cloth detachably, a movable member 32 having a Y direction driving mechanism that moves the embroidery frame 31 in the Y direction (backward and forward), and an X direction driving mechanism, included in the casing 30*a*, that moves the movable member 32 in the X direction (leftward and rightward). The X direction driving mechanism is driven by a first stepping motor 33, and the Y direction driving mechanism is driven by a second stepping motor 34 (FIG. 2).

When the embroidery frame driving device 30 is attached to the free bed of the bed 1, the motors 33 and 34 are electronically connected to a controller C of the sewing machine M via a connector 14. The controller C controls and drives the motors 33 and 34, to move the embroidery frame 31, in which a work cloth is set, in the X- and Y-axis directions individually to perform an embroidering operation.

Next, an exemplary embodiment of a control system of the sewing machine M will now be described.

As shown in FIG. 2, the controller C has an input interface 21, a CPU 22, a ROM 23, a RAM 24, a flash memory 25 (nonvolatile memory electrically rewritable), an output interface 26, and a floppy disk controller (FDC) 28 that drives the FDD 29, which are all connected via a bus 27, such as data bus.

The input interface 21 is connected to the start/stop switch 12, the touch keys 11, and a timing signal generator 16 that detects a plurality of rotating phases of the sewing machine main shaft. The output interface 26 is connected to the motors 17, 18, and 19, and a display controller (LCDC) 20 for the LCD 10.

The first and second stepping motors 33 and 34 are connected to the output interface 26 via the connector 14. A ROM 41 of the ROM card 40 is connected to the bus 27 via the connector 13.

The ROM 23 prestores basic control programs such as a sewing control and a display control required to sew utility stitch pattern, a control program required for selecting and editing an embroidery pattern to be embroidered, a sewing control program required to sew the selected and edited pattern.

Figure 3:
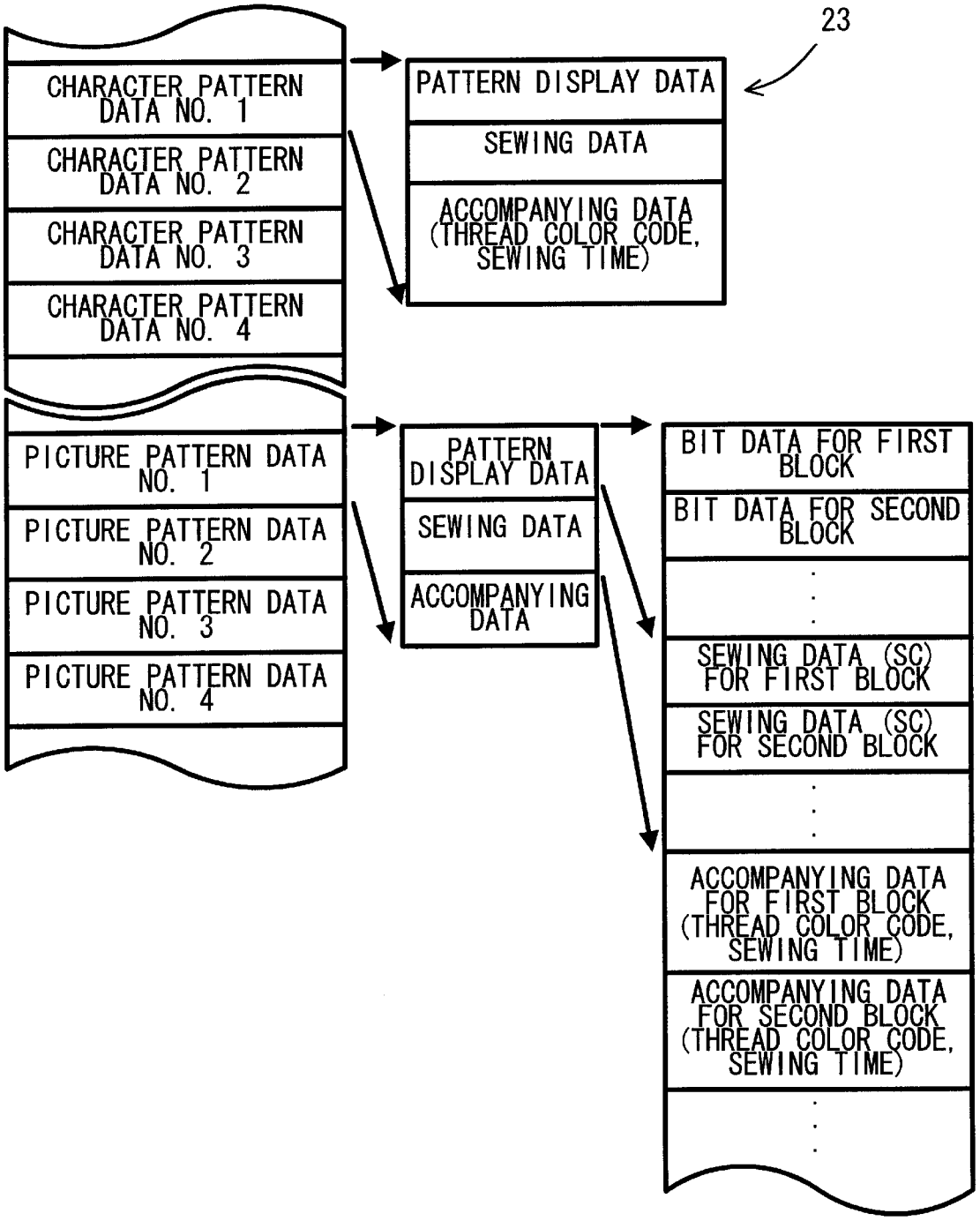
FIG. 3 is a structure of an exemplary embodiment of pattern data stored in a memory.

T he pattern data memory 23*a* of the ROM 23, stores as shown in FIG. 3, character pattern data related to letters and numerals, and picture pattern data such as animals, flowers, and frames. Character patterns and picture patterns are categorized into groups designated with numbers (like character pattern No.1, character pattern No. 2, character pattern No. 3, or picture pattern No.1, picture pattern No. 2, picture pattern No. 3).

Both character pattern data and picture pattern data are constructed of display data of bit data, sewing data consisting of pieces of stitch data (representing a stitch point position), and accompanying data (such as thread color code, sewing time), respectively.

As a picture pattern is made up of a plurality of blocks (e.g., first block, second block, and third block) which are sewn with different colors respectively, the display data, the sewing data, and the accompanying data are made for each block. A stop code SC suspends sewing operation at the end of each block for thread changing, and it is stored in the last of the sewing data for each block.

The ROM card 40 has a plurality of versions available on the sewing machine M. Pattern data for a plurality of embroidery patterns (e.g. the first embroidery pattern, the second embroidery pattern, the third embroidery pattern) are stored in the ROM 41 of each ROM card 40 with the same structure in the ROM 23. The FD 45 is also available for storing pattern data and editing them. The RAM 24 includes various memories (e.g., flag memory, pointer memory, counter memory, register, buffer) required for each control described above.

In the sewing machine M, as shown in FIGS. 4 to 14, the LCD 10 is designed as a vertically long rectangle (aspect ratio being 2:3). The pattern display area 51 is established in the portrait orientation on the upper left of the LCD 10 with a size of approximately ⅗ of the LCD 10. In the pattern display area 51, the selected pattern can be edited while being displayed.

Figure 5:
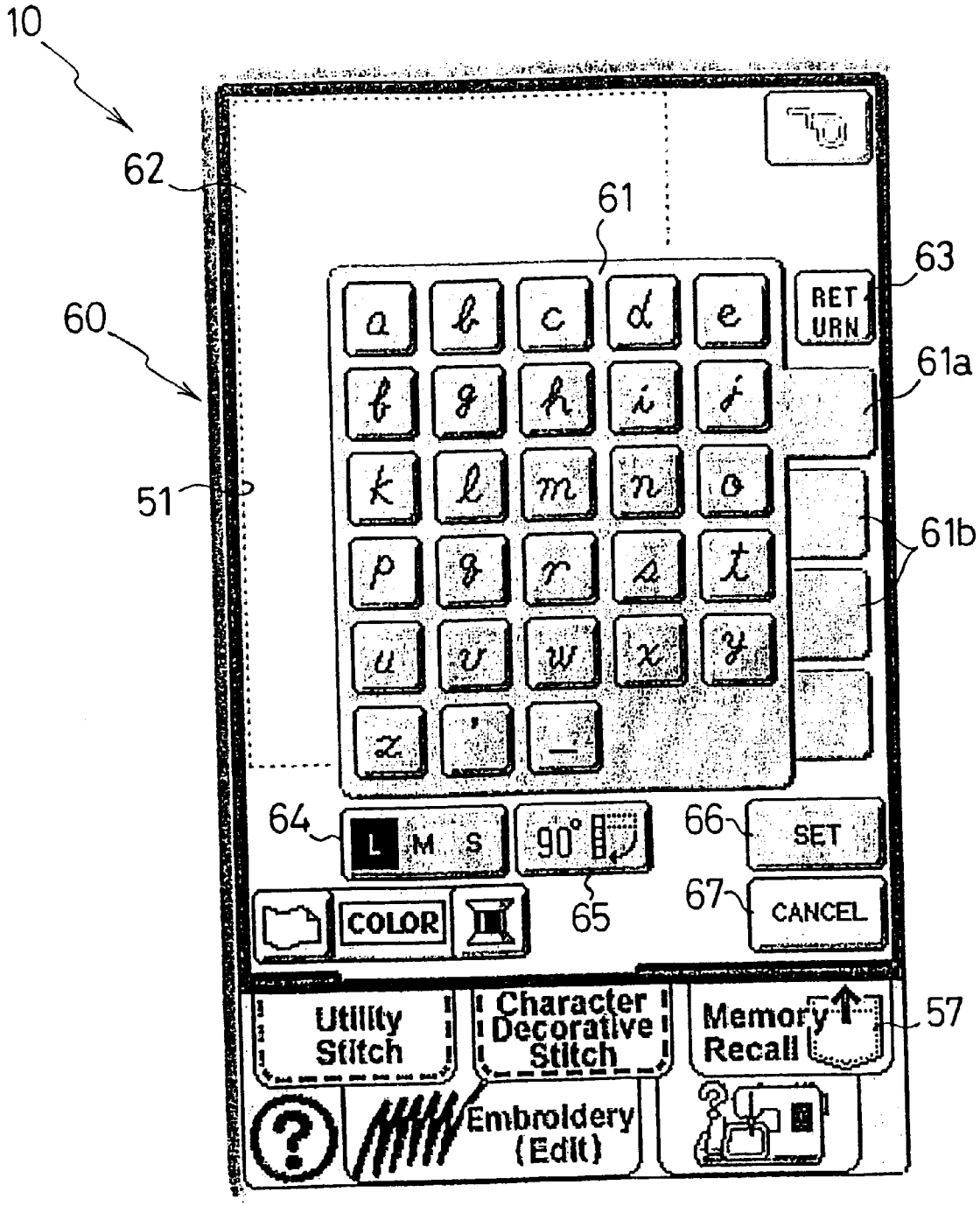
FIG. 5 is an exemplary embodiment of a character pattern selection screen displayed on the display.
Figure 6:
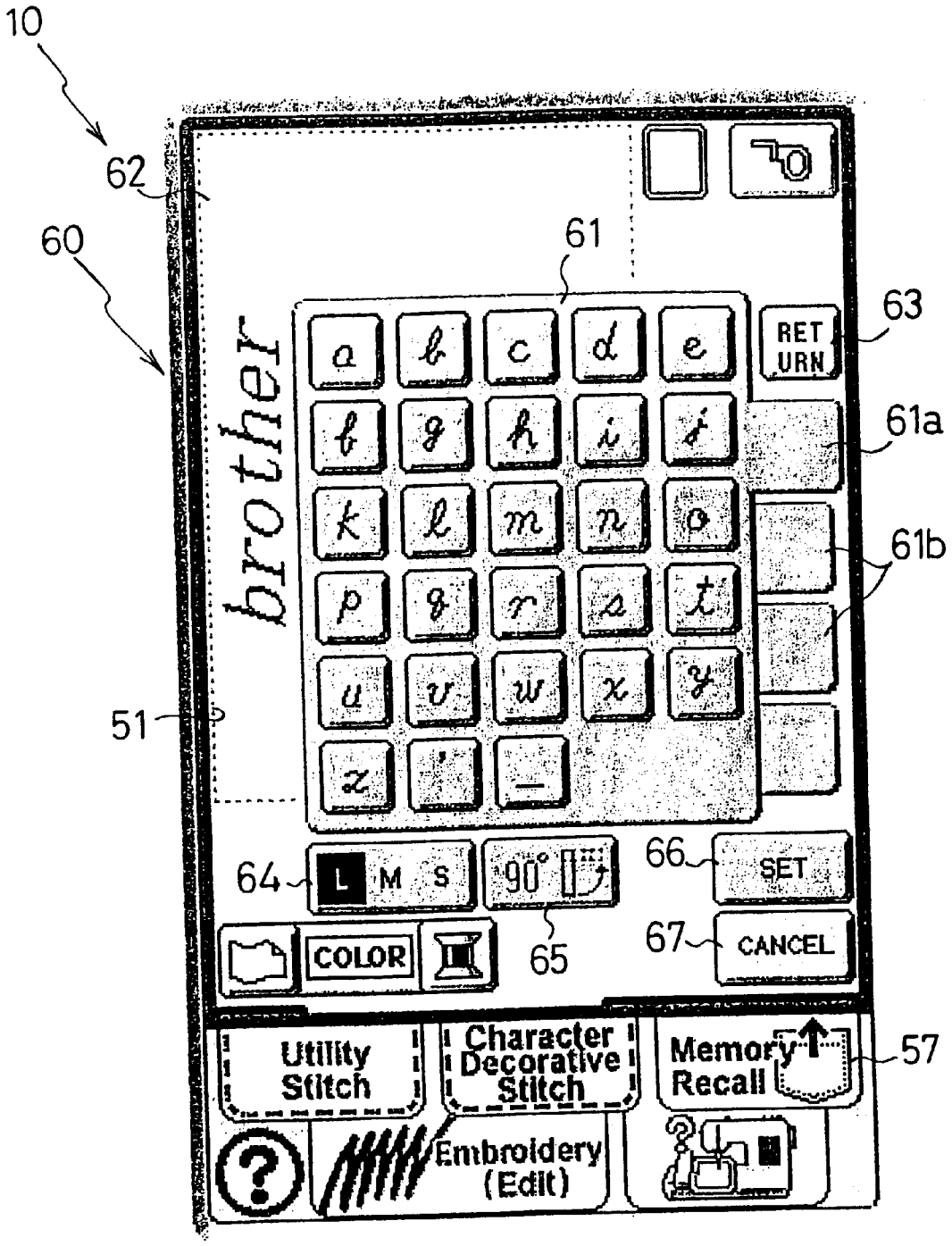
FIG. 6 is the character pattern selection screen of FIG. 5 after character patterns are selected.

As shown in FIGS. 5 and 6, when a character pattern is selected, the LCD 10 simultaneously shows the pattern display area 51 and a character pattern selection area 61 where a character pattern is selectable on the same screen (the character selection screen 60) in piles. The whole character selection area 61 is displayed. A remaining displayable area 62, that is a part of the pattern display area 51 and does not overlap the character pattern selection area 61, is displayed.

The pattern display area 51 appears on the upper left of the LCD 10, and the character selection area 61 substantially in a quadrangle appears in the center of the LCD 10. Thus, the remaining displayable area 62 is positioned on the left and the top of the character selection area 61.

When the selected character pattern is in a vertical writing orientation wherein the normal orientation of the letters relative to each other is maintained, as shown in FIG. 6, the whole character pattern is displayed in the left part of the remaining displayable area 62. On the contrary, when the selected character pattern is in the horizontal writing orientation although it is not shown, the whole character pattern is displayed in the upper part of the remaining displayable area 62.

The pattern display area 51 and the character selection area 61 are displayed on a part of the LCD 10. The remaining part of the LCD 10, especially the lower part of these areas 51 and 61, is designed to show various function keys such as a size (L/M/S) key 64, a character array key 65, a SET key 66, a CANCEL key 67, and a Memory Recall key 57.

Figure 10:
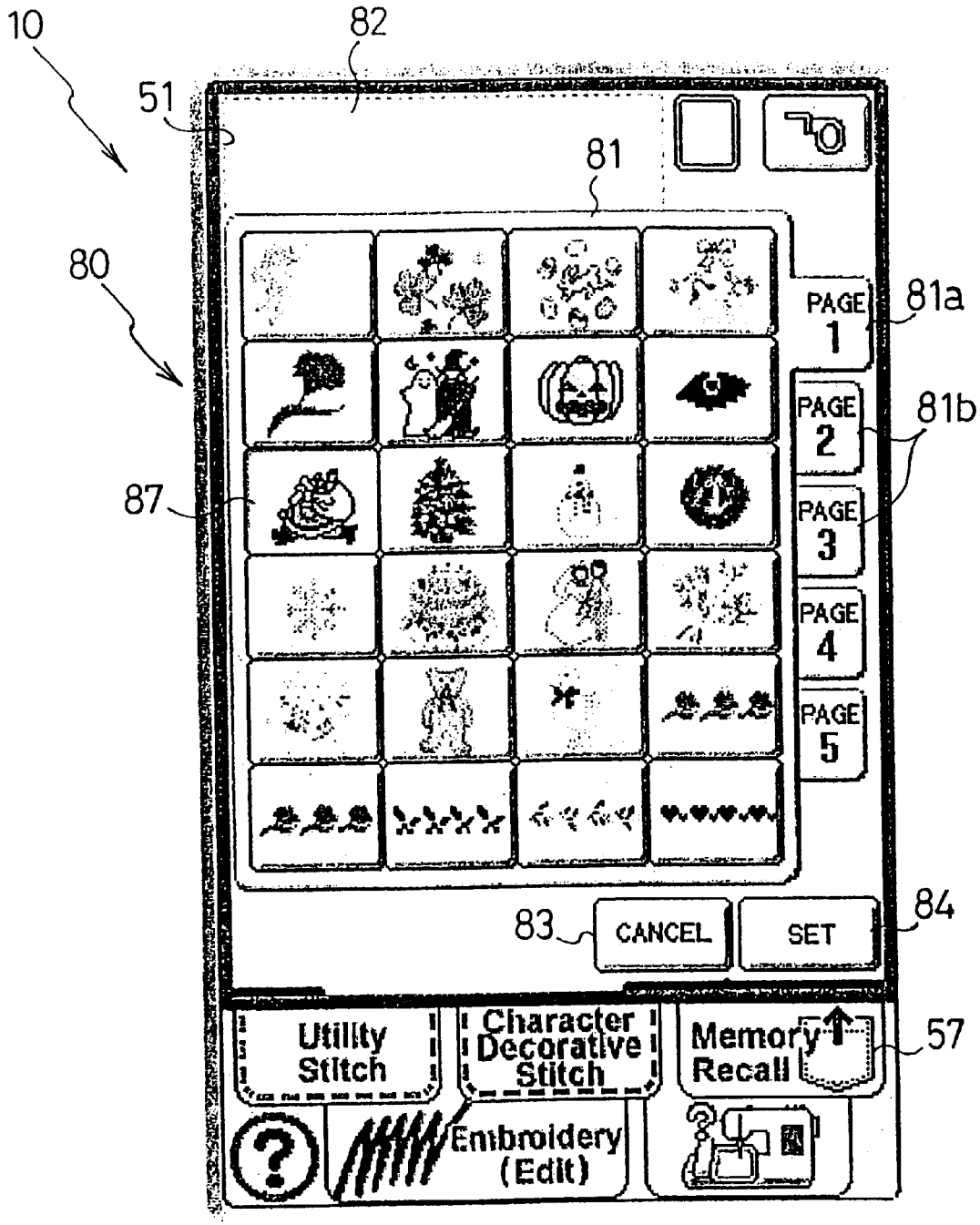
FIG. 10 is an exemplary embodiment of a picture pattern selection screen displayed on the display.

On the other hand, as shown in FIG. 10, when a picture pattern is selected, the pattern display area 51 and a picture pattern selection area 81 are displayed overlapping on the same screen (a picture pattern selection screen 80) of the LCD 10. The whole picture pattern selection area 81 is displayed. A remaining displayable area 82, that is a part of the pattern display are 51 and does not overlap the picture pattern selection area 81, is displayed on the upper portion of the LCD 10 relative to the picture pattern selection area 81.

The pattern display area 51 and the picture pattern selection area 81 are displayed on a part of the LCD 10. The remaining part of the LCD 10, especially in the lower part of the LCD 10 relative to these areas 51 and 81, is designed to show various function keys such as a CANCEL key 83, a SET key 84, and the Memory Recall key 57.

Figure 7:
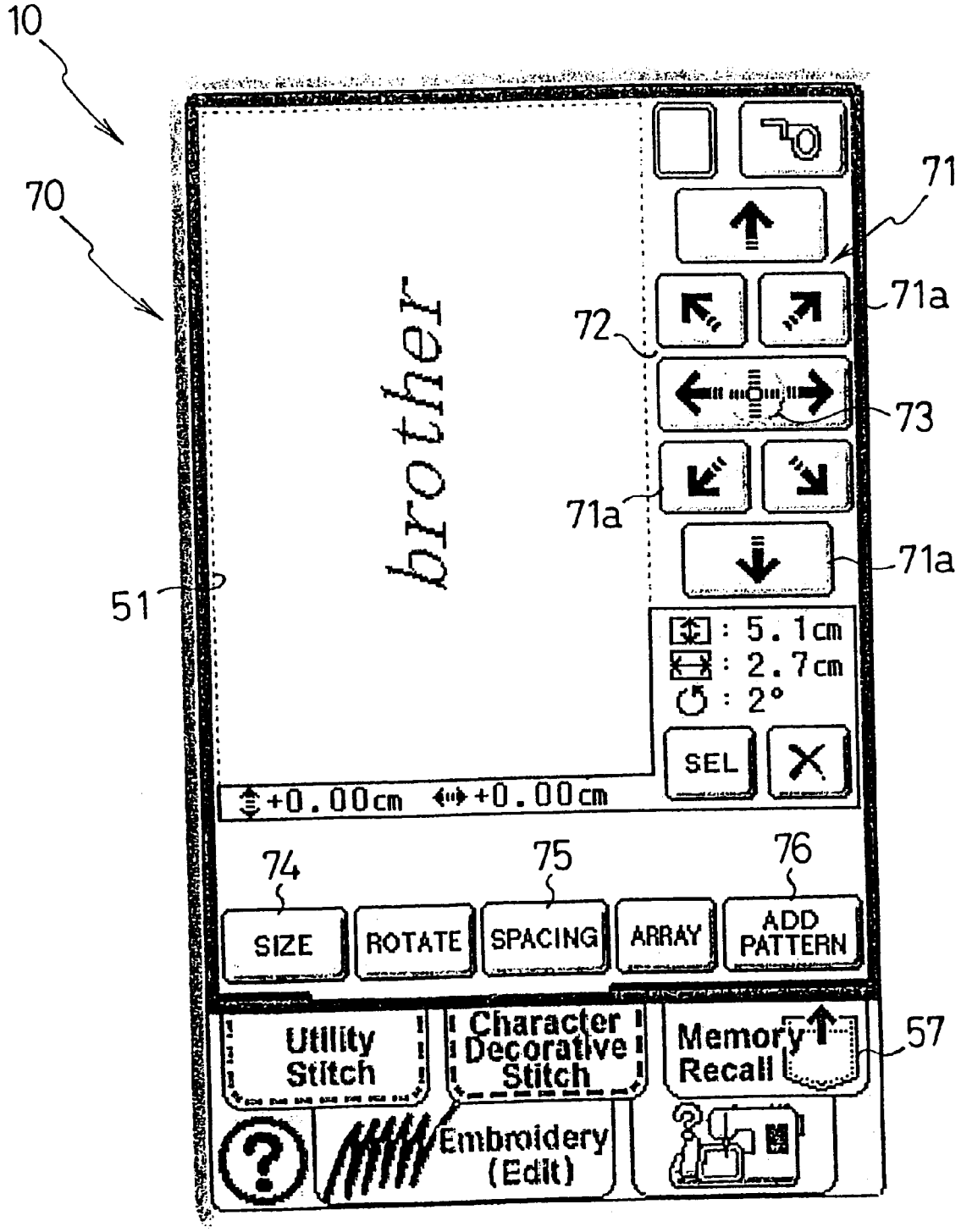
FIG. 7 is an exemplary embodiment of a pattern edit screen displayed on the display.

After the selection of the character pattern is completed, the pattern selection screen 60 of FIG. 6 is switched to the pattern edit screen 70 of FIG. 7. At this time, the pattern selection area 61 is cleared, and the selected character pattern is displayed in the center of the pattern display area 51. Even in selecting a pattern, the pattern can be displayed for confirmation in the remaining displayable area 82 of the pattern selection screen 80 of FIG. 10.

Figure 8:
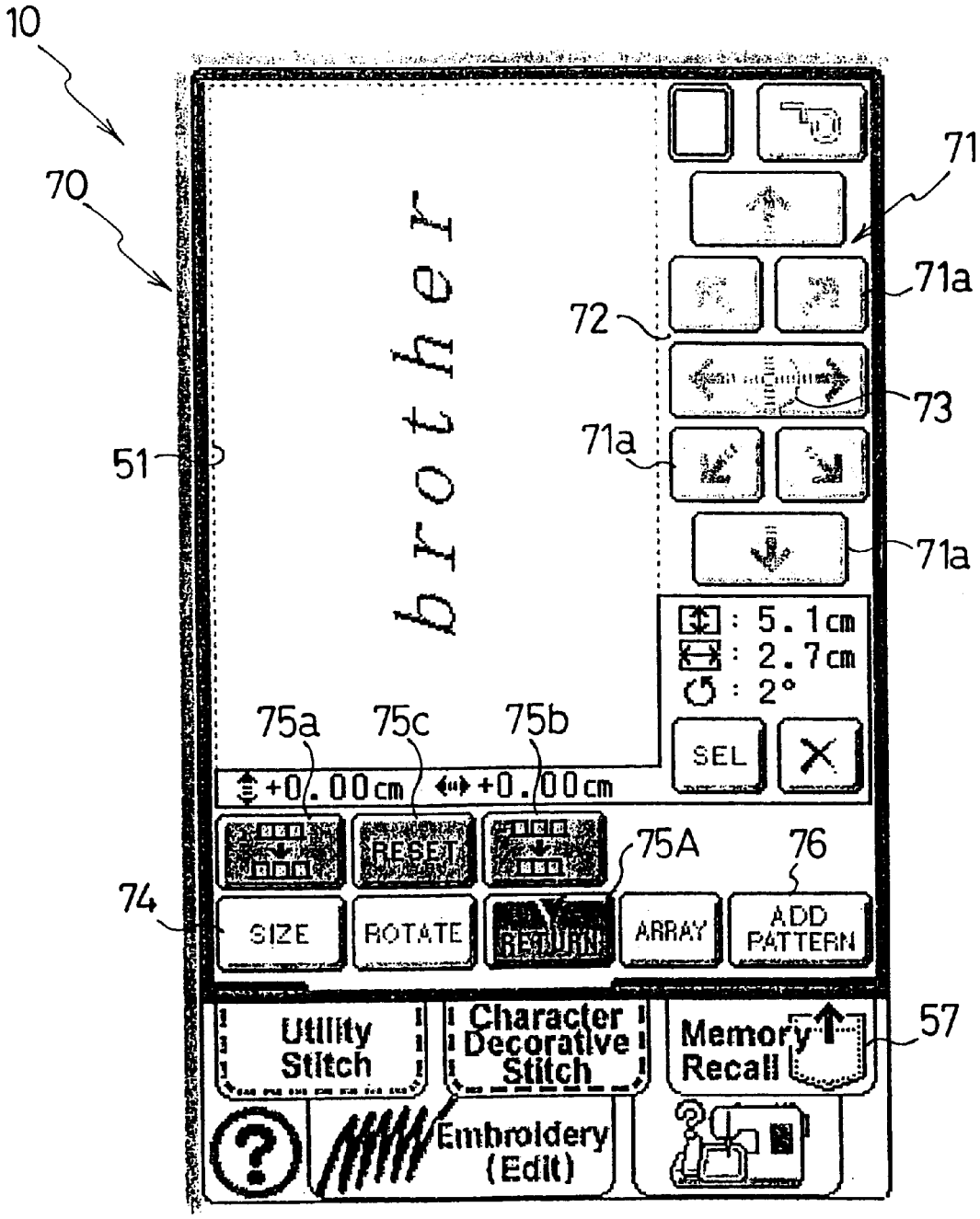
FIG. 8 is the pattern edit screen of FIG. 7 in which proportional spacing is applied.
Figure 11:
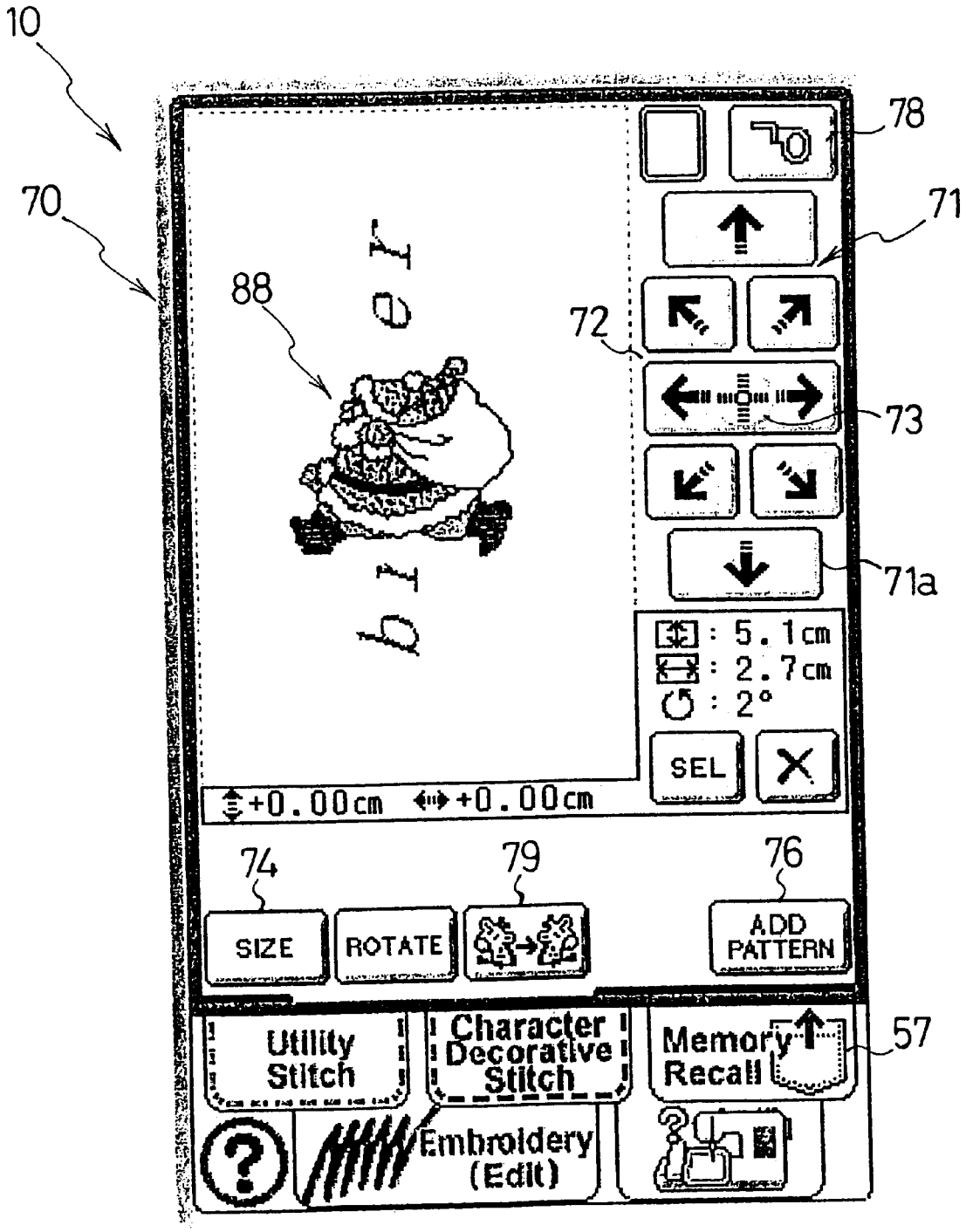
FIG. 11 is an exemplary embodiment of a pattern edit screen after a picture pattern is selected.

As shown in FIGS. 7, 8, and 11, when a character or picture pattern to be embroidered is edited, eight-direction keys 71 to input an order to move the pattern in one of the eight different directions within the pattern display area 51 of the pattern edit screen 70, are displayed in a rectangular direction key display area 72 which is on the right of the pattern display area 51. A center key 73 to input an order to position the pattern in the center of the pattern display area 51, is displayed in the center of the eight direction keys 71 with a three dimensional effect. These keys function in the same manner as the touch keys 11.

The pattern edit screen 70 shown in FIG. 7 is structured to display pattern edit keys arranged horizontally, including the SIZE key 74, the SPACING key 75, and the ADD PATTERN key 76, under the pattern display area 51 and the direction key display area 72. The pattern edit screen 70 shown in FIG. 11 is structured to display the SIZE key 74, the mirror key 79, the ADD PATTERN key 76. In both cases, the pattern edit screen 70 further includes edit keys such as the Memory Recall key 57 on the lower part of the LCD 10.

The direction key display area 72 is divided into the five areas, each displaying one or two direction keys 71*a* of the eight direction keys 71. In the area displaying the two directly-opposed keys, these keys are displayed in connection and the center key is displayed in the center of these keys with a three dimensional effect.

Next is an explanation about routines regarding the pattern selection control executed in the controller C with reference to the flowcharts of FIGS. 15 to 18. The routines will be explained on the assumption the character pattern "brother" with normal font, and the picture pattern "Santa Claus" are taken for example. In the flowcharts, Si (i=1, 2, . . . ) stands for a procedure step.

Figure 15:
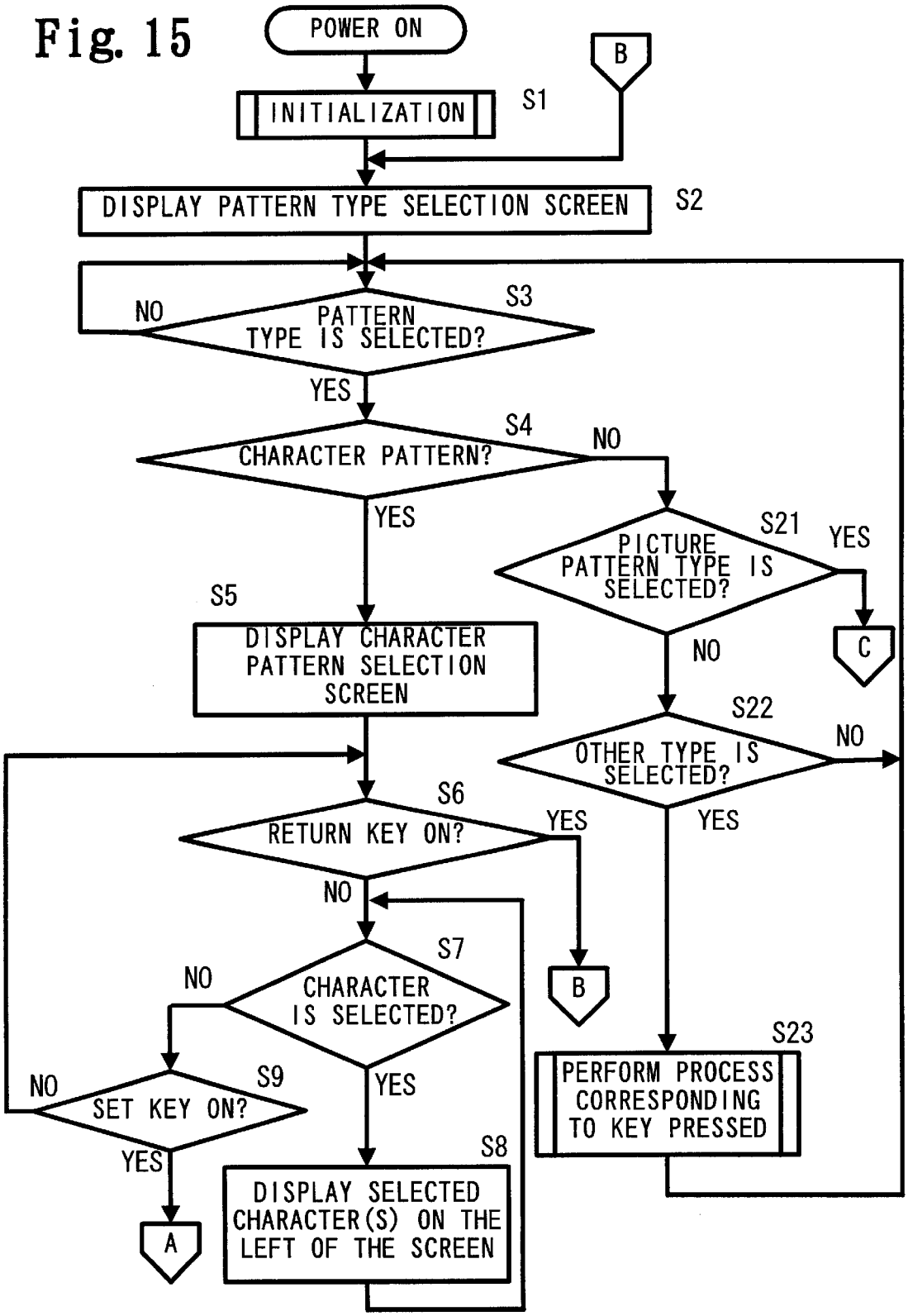
FIG. 15 is a flowchart of an exemplary embodiment of a pattern selection and edit control (¼)

As shown in FIG. 15, when the power is turned on, and this control is started, initialization such as clearing each memory in the RAM 24 is performed (S1). When the embroidery frame driving device 30 is attached to the machine M, the pattern type selection screen 50 of FIG. 4, in which a pattern type is selected, is displayed on the LCD 10 (S2).

The pattern type selection screen 50 shows the pattern display area 51, on the right, vertically from the top, three different font character pattern selection keys 52, two picture pattern selection keys 53, a special character selection key 54, a ROM card selection key 55, and an FD selection key 56. The screen 50 displays further keys such as the Memory Recall keys 57 below the pattern display area 51 and the above-mentioned keys.

When a pattern type is selected by pressing one of the font character pattern selection keys 52 (the top one, for example) (S3: Yes) and the selected pattern type is character pattern (S4: Yes), the character pattern selection screen 60 of FIG. 5 is displayed on the LCD 10 (S5). When a character pattern type is selected, a plurality of lowercase letters are initially displayed on a first page of the matrix indicated by tab 61*a*. If display change tab 61*b* is pressed, another kind of letters, for example, uppercase, or capital letters can be displayed.

When the RETURN key 63, which is on the upper right of the character pattern selection area 61, is pressed (S6: Yes), the procedure returns to S2 and the pattern type selection screen 50 is displayed again. When the RETURN key 63 is not pressed (S6: No), and letter keys "b", "r", "o", "t", "h", "e", and "r" are pressed and selected (S7: Yes), each letter is displayed in the remaining displayable area 62 on the left of the screen and placed so that their reading orientation is parallel to a vertical line (S8). Finally, "brother" of the selected letters is arranged lengthways in the remaining displayable area 62 as shown in FIG. 6.

When "brother" is selected with the conditions that the pattern size is set to L (large) using the size key 64 and the array orientation is set to vertical orientation using the character array key 65, "brother" is displayed in the L size and the vertical array in the remaining displayable area 62. After that, the SET key is pressed (S9: Yes), the pattern "brother" is decided to be embroidered, and the procedure goes to S10 of FIG. 16. When the CANCEL key 67 is pressed, the selection of the pattern "brother" is canceled.

Figure 16:
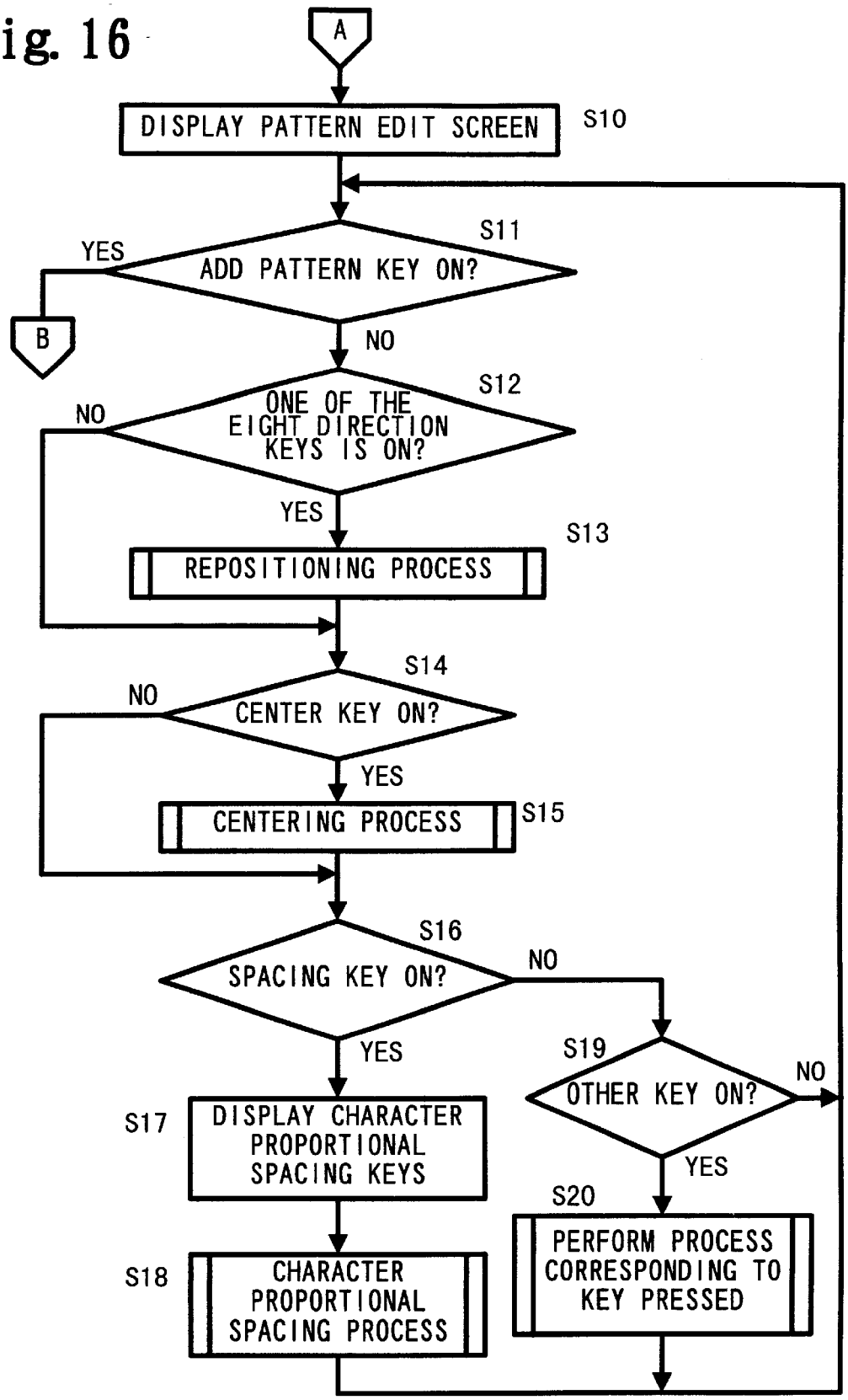
FIG. 16 is the flowchart of a pattern selection and edit control (2/4)

When the SET key 66 is pressed, the pattern edit screen 70 of the FIG. 7 is displayed on the LCD 10 as shown in FIG. 16 (S10). When the ADD PATTERN key 76 is not pressed (SI 1: No) and one of the eight direction keys 71 is pressed (S12: Yes), the repositioning process (S13) is performed, the pattern "brother " is moved in the direction the pressed key 71 a indicates within the pattern display area 51. When the center key 73 is pressed (S14: Yes), centering (S15) is performed, and the pattern "brother" is placed in the center of the pattern display area 51.

When the SPACING key 75 is pressed (S16: Yes), the RETURN key 75A is displayed instead of the SPACING key 75, and character proportional spacing keys 75*a* and 75*b*, and the RESET key 75*c* are displayed between the pattern display area 51 and the SPACING key 75, with the same color, as shown in FIG. 8.

At the character proportional spacing process (S18), the character proportional spacing key 75*a* is used to widen the spacing among letters "brother", for example, from the spacing indicated in FIG. 7 to the spacing indicated in FIG. 8. The character proportional spacing key 75*b* is used to reduce the spacing. The RESET key 75*c* enables returning to the initial character spacing. When the RETURN key 75A is pressed, the character proportional spacing process is terminated.

Figure 9:
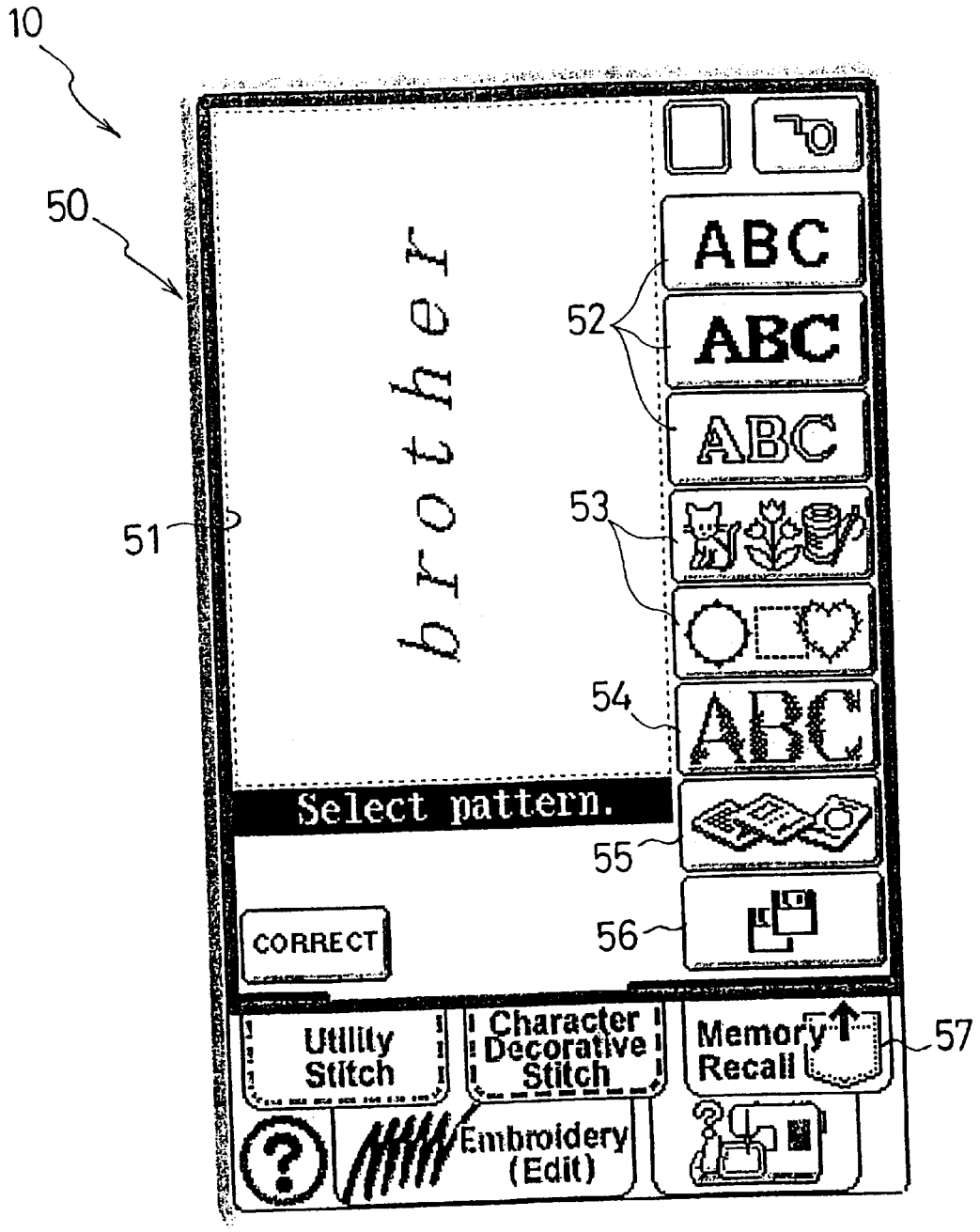
FIG. 9 is pattern type selection screen of FIG. 4 displayed on a display.

When the SPACING key 75 is not pressed (S16: No) and another key is pressed (S19: Yes), a process corresponding to the key pressed is performed (S20). After that, or when another key is not pressed (S19: No), the procedure returns to S11. When the ADD PATTERN key 76 is pressed, the editing of the pattern "brother" is completed, the procedure returns to S2, the pattern "brother" remains displayed in the pattern display area 51, and the pattern type selection screen 50 is displayed on the LCD 10 as shown in FIG. 9.

As shown in FIG. 15, when the picture pattern selection key 53, representing a cat and flower, is pressed (S3: Yes), and the picture pattern type is selected (S21: yes), the procedure goes to S24 of FIG. 17. On the other hand, when the picture pattern type is not selected and another key, such as the ROM card key and the FD key, is pressed (S21: No, S22: Yes), a process corresponding to the key pressed is performed (S23) and the procedure returns to S3.

Figure 17:
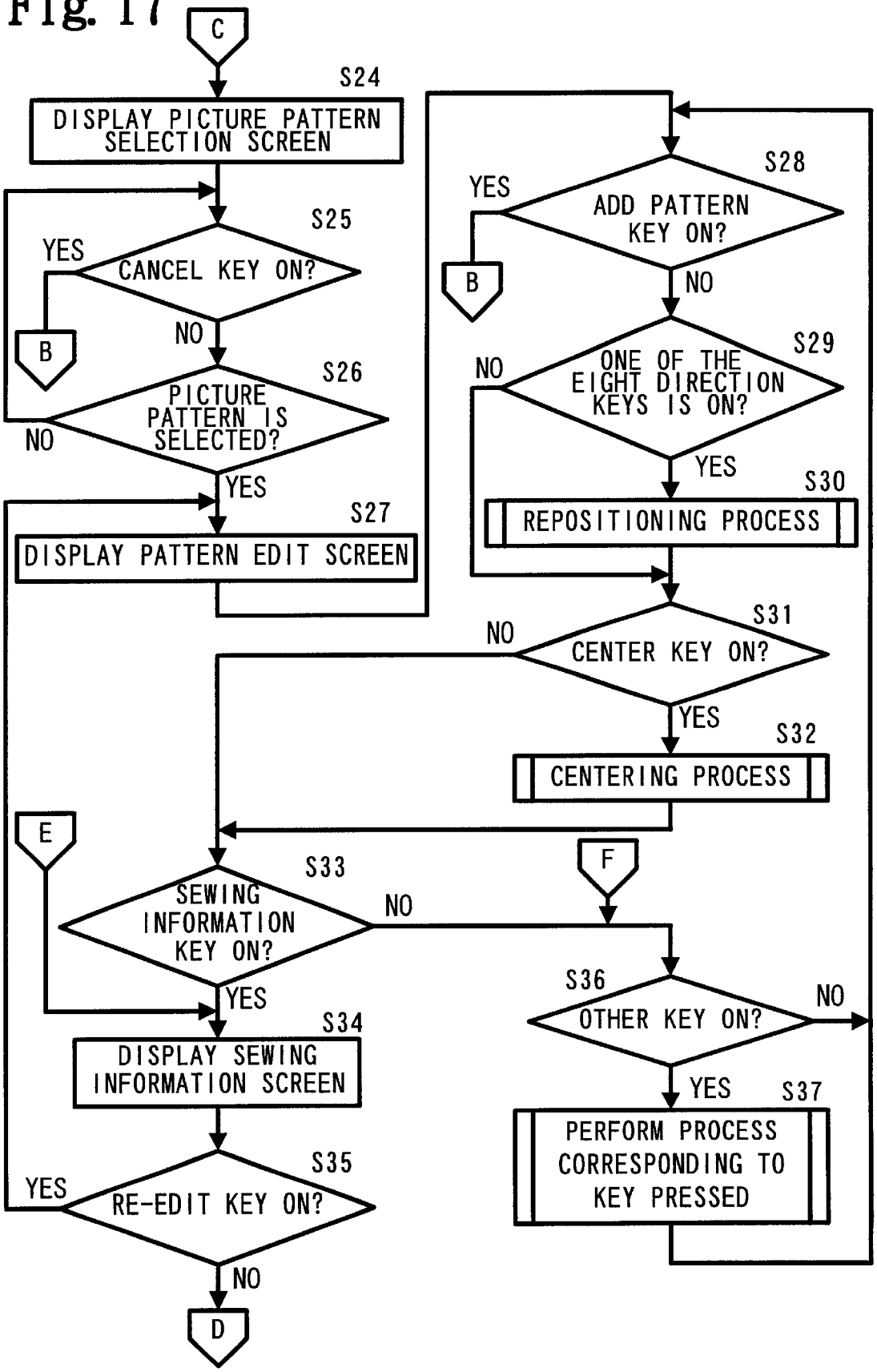
FIG. 17 is the flowchart of a pattern selection and edit control (¾)
Figure 18:
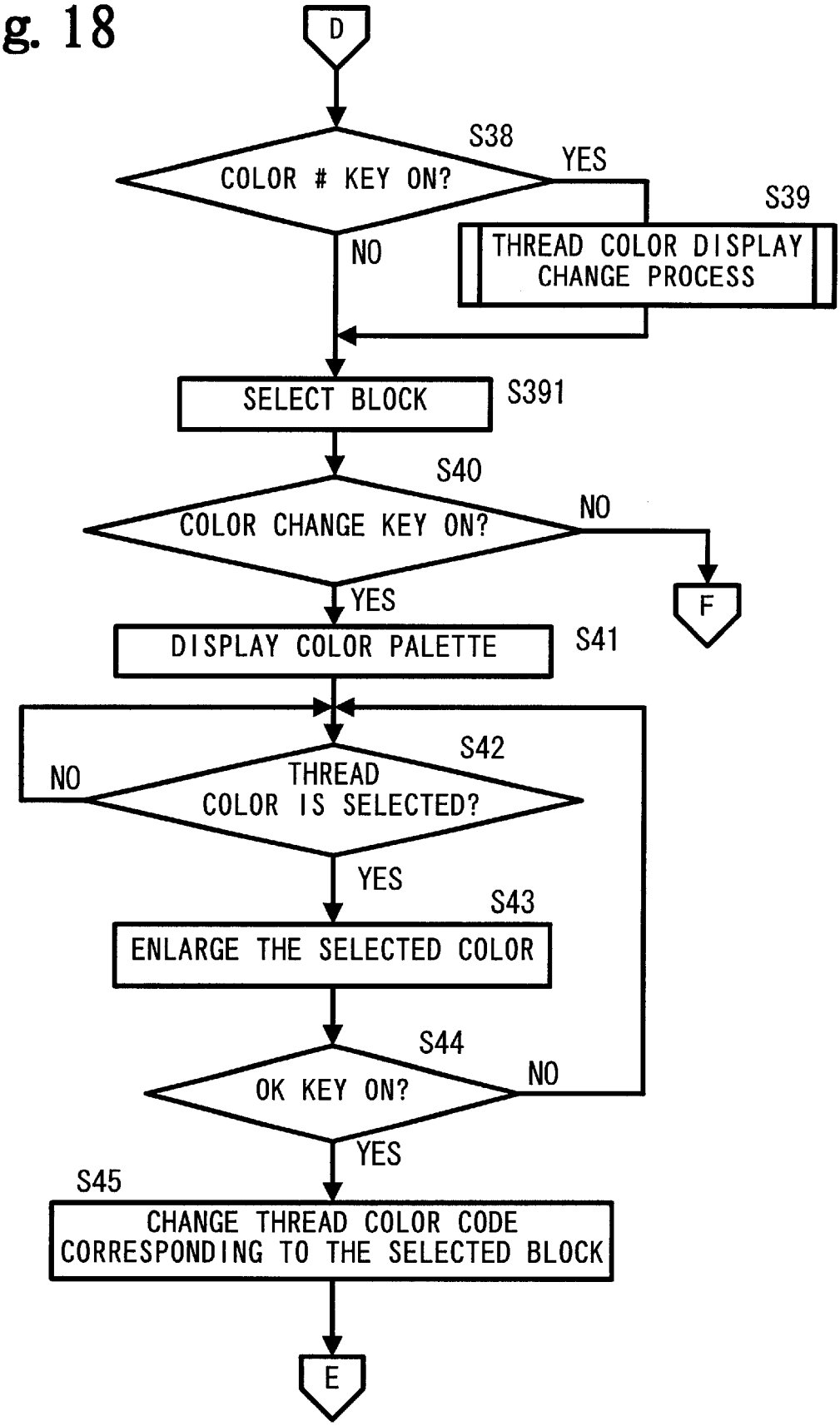
FIG. 18 is the flowchart of a pattern selection and edit control (4/4)

When the picture pattern type is selected, as shown in FIG. 17, the picture pattern selection screen 80 appears on the LCD 10 (S24). When the picture pattern type is selected, a plurality of picture patterns registered on the first page, indicated by page tab 81*a,* are displayed, as shown in FIG. 10. When another page tab 81*b* corresponding to page 2 to page 5 is selected, picture patterns registered on the page of the tab selected can be displayed.

When the CANCEL key 83 is pressed (S25: Yes), the procedure returns to S2 and the previous pattern type selection screen 50 of FIG. 9 is displayed. When the CANCEL key 83 is not pressed (S25: No) and the pattern "Santa Claus" 87 is selected from a plurality of picture patterns (S26: Yes), the pattern edit screen 70 of FIG. 11 appears on the LCD 10 (S27).

On the pattern edit screen 70, the display of the picture pattern selection area 81 is cancelled, the pattern "Santa Claus" 88 is displayed in the center of the pattern display area 51 overlapping the character pattern "brother". As with the pattern edit screen of FIGS. 7 and 8, the eight direction keys 71 and the center key 73 are displayed.

When the ADD PATTERN key 76 is not pressed (S28: No) and one of the eight direction keys 71 is pressed (S29: Yes), a repositioning process is performed (S30), where only the pattern "Santa Claus" is moved in the direction that the pressed key 71 a indicates within the pattern display area 51. When the center key 73 is pressed (S31: Yes), centering is performed (S32), and only the pattern "Santa Claus" is positioned in the center of the pattern display area 51. When the sewing information key 78 is pressed (S33: Yes), the editing of the picture pattern "Santa Claus" is completed and the sewing information screen 90 of FIG. 12 appears on the LCD 10 (S27).

The picture pattern "Santa Claus" 88 is, for example, made up of the following six blocks: a first block 88*a* consisting of a part of the hat and the clothing, a second block 88*b* representing the presents, a third block 88*c* consisting of a part of the hat, the beard, and the belly-warmer tie, a fourth block 88*d* representing patterns in the clothing, a fifth block 88*e* representing the shoes and the outline, and a sixth block 88*f* representing the present bag. Each block 88*a* to 88*f* is provided with bit data, sewing data, and accompanying data.

Figure 12:
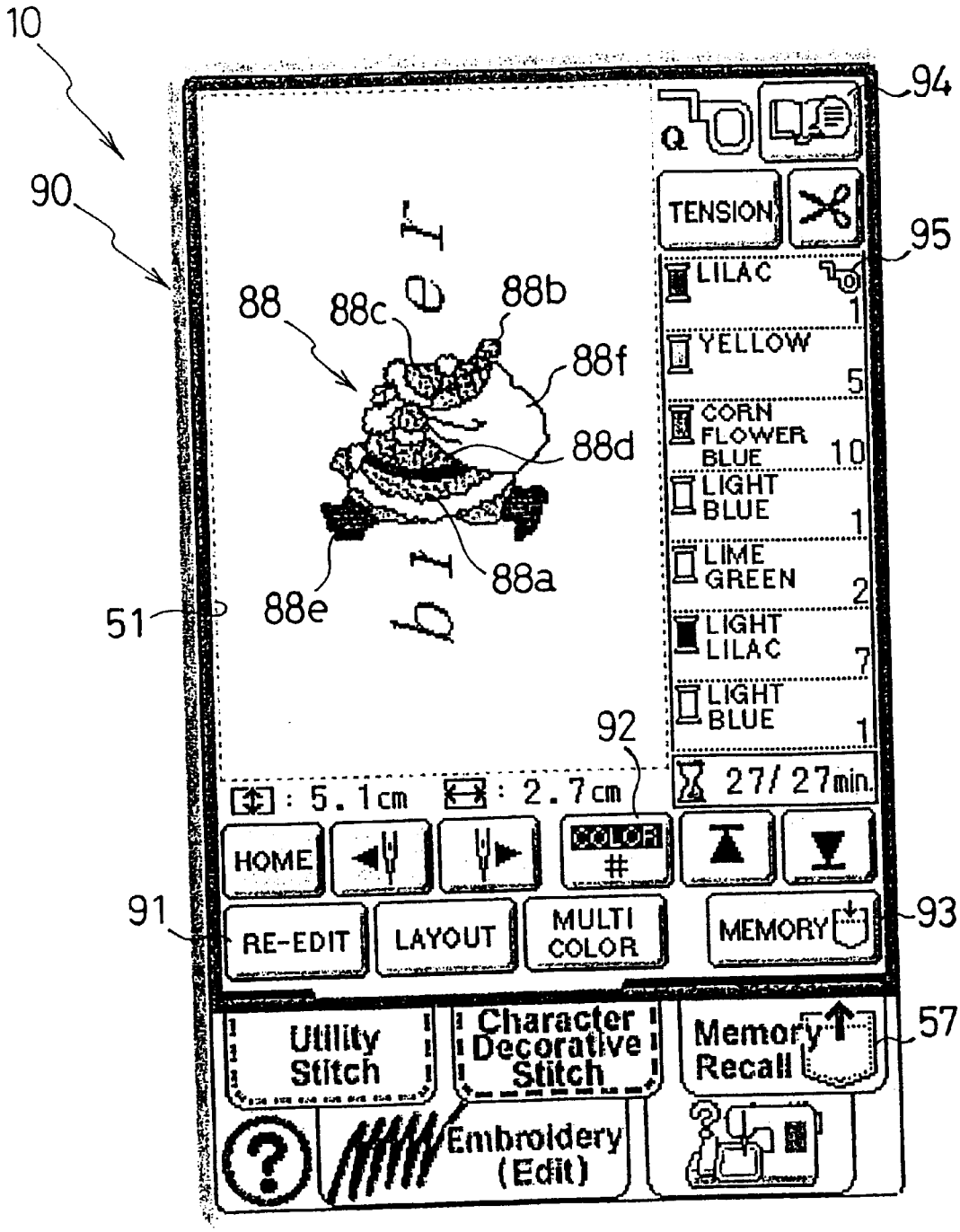
FIG. 12 is an exemplary embodiment of a sewing information screen showing thread color names displayed on the display.

On the sewing information screen 90, the right side of the pattern display area 51 shows sewing information on each block of the embroidery pattern. The sewing information on each block (area sewn with one color) is a set of a thread spool icons representing the colors of the threads used therein, a color name of each thread, and a sewing time, which are found from the thread color code and sewing time data allotted in each block stored in the accompanying data. The sewing information is displayed in order of embroidery. In FIG. 12, for example, the first embroidery is the character pattern "brother" embroidered with lilac color thread for 1 minute, and the second one is the first block 88*a* of the picture pattern "Santa Claus" 88 embroidered with yellow thread for 5 minutes.

The sewing information screen 90 further shows various keys such as the REEDIT key 91, the COLOR # key 92, and the MEMORY key 93 below the pattern display area 51. Further below, keys such as the Memory Recall key 57 are provided as with the previous screen.

Figure 14:
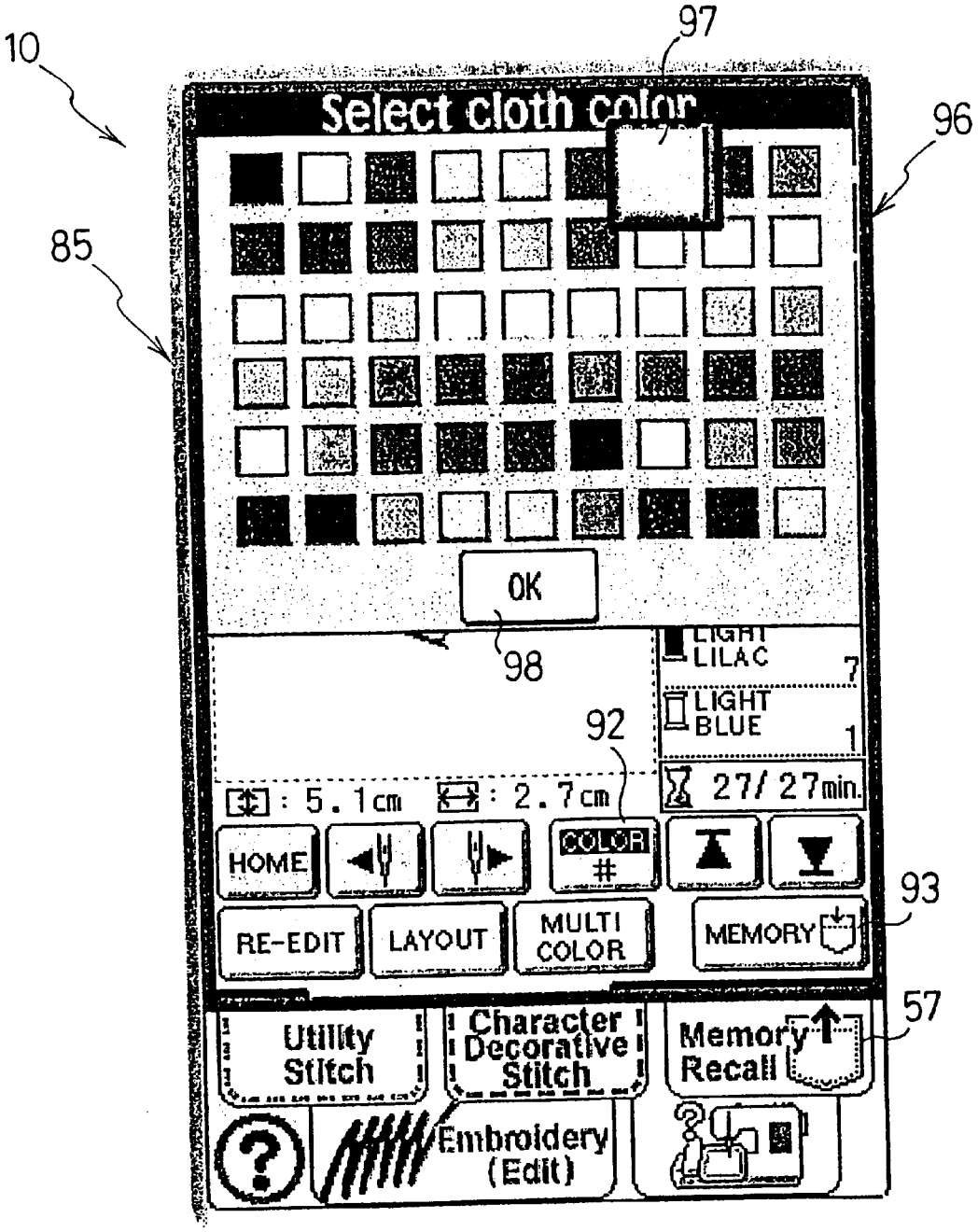
FIG. 14 is an exemplary embodiment of a screen including a color palette.

When an area displaying a thread color or number to be changed is specified(S391) and the color change key 94, which is on the upper right corner of the screen, is pressed (S40: Yes), a color palette 96 is displayed on the upper part of the LCD 10 (S41) as shown in FIG. 14. The color palette 96 shows different colors (54 colors, for example) each in a small rectangle. When a desired color rectangle 97 is pressed and specified (S42: Yes), the specified color (the rectangle 97) is enlarged (S43).

Even if the rectangle 97 is enlarged, another color rectangle can be pressed and selected. The color rectangle is enlarged while it is selected. When the OK key 98 is pressed (S44: Yes), the thread color name and code currently set in the selected block are changed to those of the specified color (S45), and the procedure returns to S34.

When the color change key 94 is not pressed (S40:No), and another key is pressed (S36: Yes), a process corresponding to the key pressed is performed (S37). When another key is not pressed (S36: No), the procedure returns to S28.

Figure 13:
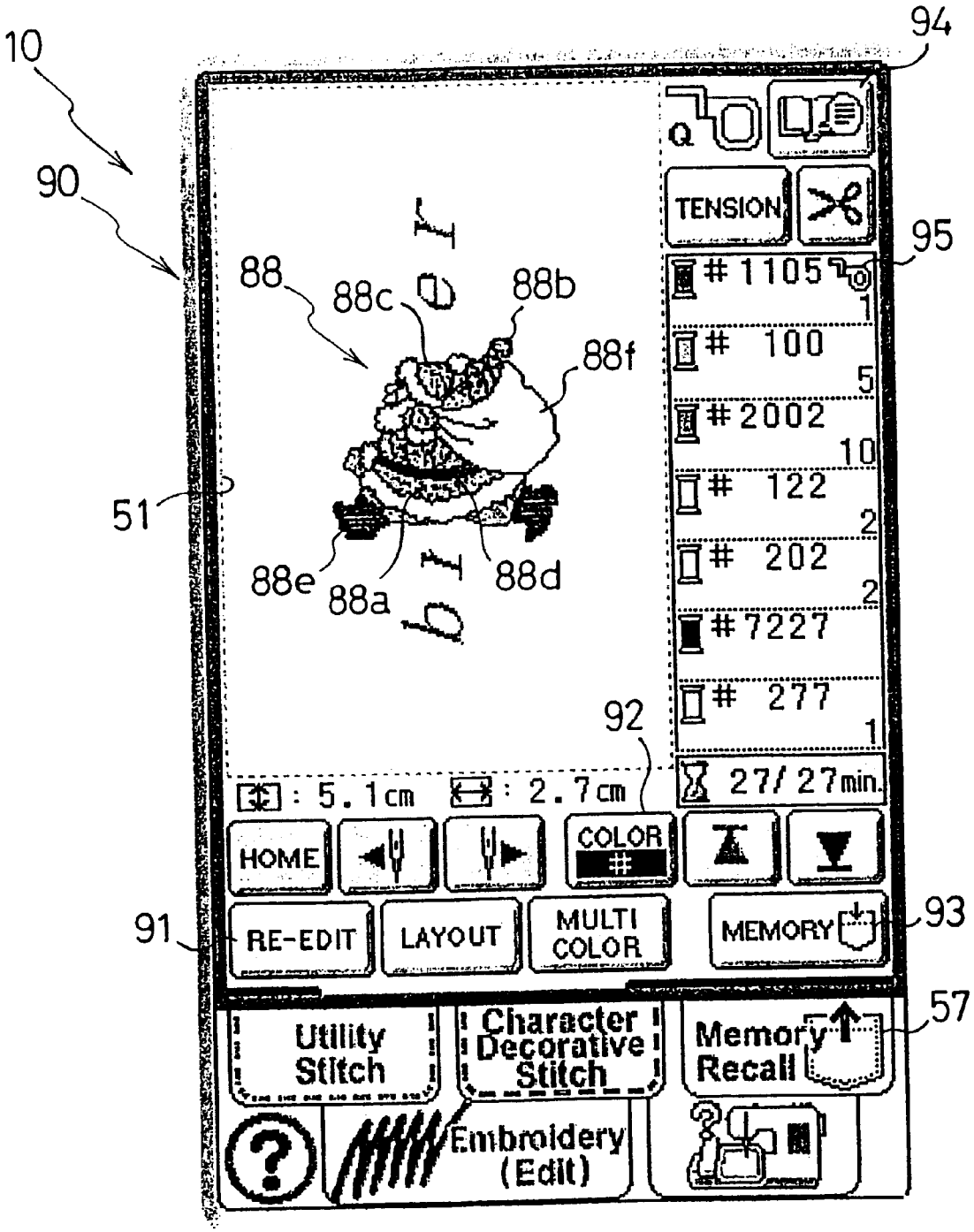
FIG. 13 is the sewing information screen of FIG. 12 showing thread numbers displayed on the display.

For example, when an area representing a thread color or number is pressed on the sewing information screen 90 of FIGS. 12 and 13, a presser foot mark 95 is displayed therein, and a block composed of the pattern "brother" or "Santa Claus" 88, in which the thread is used, becomes a target of thread color change. When the thread color is changed, the sewing information for the block is also changed.

When the start/stop switch 12 is turned on, first the character pattern "brother" is embroidered as the sewing mechanism of the needle bar driving mechanism and the embroidery frame driving device 30 are driven and controlled based on the sewing data set in each character. Then, the picture pattern "Santa Claus" 88 is embroidered as the sewing mechanism of the needle bar driving mechanism and the embroidery frame driving device 30 are driven and controlled based on the sewing data set in each of first to sixth patterns 88*a* to 88*f*.

The sewing mechanism and the embroidery frame driving device 30 are suspended when the embroidery is completed per block (that is, when the pattern "brother" is embroidered and each block of the pattern "Santa Claus" 88 is embroidered). During the suspension, the thread spool is changed by the operator. After the thread is changed, the start/stop switch 12 is turned and the following block is embroidered with the thread changed. All blocks are embroidered in this manner.

When the MEMORY key 93 is pressed on the sewing information screen 90 of FIGS. 12 and 13, the pattern currently being displayed and edited can be stored in the flash memory 25. When the Memory Recall key 57 is pressed and a specified operation is made with a touch of screen, the pattern stored in the flash memory 25 can be called up and used for embroidery.

According to the machine M, when a character pattern is selected, the pattern display area 51 and the character pattern selection area 61 are simultaneously displayed overlapping on the same screen (the character pattern selection screen 60) of the LCD 10, as shown in FIGS. 5 and 6. The screen 60 is designed to display the whole of the character pattern selection area 61 and the remaining displayable area 62 that is a part of the pattern display area 51 and is not overlapped with the area 61.

As shown in FIG. 6, when the selected character pattern is made up of a group of letters and the array orientation is set to the vertical orientation (each letter being placed so that their reading orientation is parallel to a vertical line), all letters can be displayed in the remaining displayable area 62 which is on the left. This enables the operator to see and grasp the size and the orientation of the pattern and the array orientation of the pattern on the whole in the pattern display area 51. Therefore, the selected character pattern can be easily changed during the selection of the character pattern, which can make full use of the capabilities of presetting of the size and the array orientation of the pattern made of the group of letters.

Because the whole of the character pattern can be displayed in the remaining displayable area 62, not only the layout, such as the size and the orientation of the character pattern and the array orientation of the character pattern, but also the contents of the pattern (what letters have been selected) can be grasped during the selection of an embroidery pattern. When the character pattern is placed horizontally so that the letters assume their normal orientation relative to each other, the whole of the character pattern can be displayed in the remaining displayable area 62 which is on the top of the screen.

After the character pattern selection is completed, the pattern selection screen 60 of FIG. 6 is switched to the pattern edit screen 70 of FIG. 7. At this time, the display of the character pattern selection area 61 is cancelled and the selected character pattern is displayed in the center of the pattern display area 51. Therefore, the pattern can be placed in the center of the pattern display area 51, which is the initial position for editing the pattern.

As the LCD 10 is designed in the portrait orientation, the pattern display area 51 and the character pattern selection area 61 (or the picture pattern display area 81) can be displayed in the upper part of the LCD 10, and various information can be displayed in the remaining part, that is, below the pattern display area 51 and the character pattern selection area 61 (or the picture pattern display area 81).

In the embodiment, as shown in FIGS. 5 and 6, the display data for one or more sets of character patterns, which are arranged in the matrix of lines and columns on the LCD 10, are created from the sewing data for each character pattern. The display data for one or more sets of the picture patterns, which are arranged in the matrix of lines and columns on the LCD 10 as shown in FIG. 10, are pre-stored in the ROMs 23 and 41.

The display data for the character patterns can be pre-stored in the ROMs 23 and 41. The display data for the picture patterns can be created from the sewing data for each picture pattern, without being pre-stored.

Figure 19:
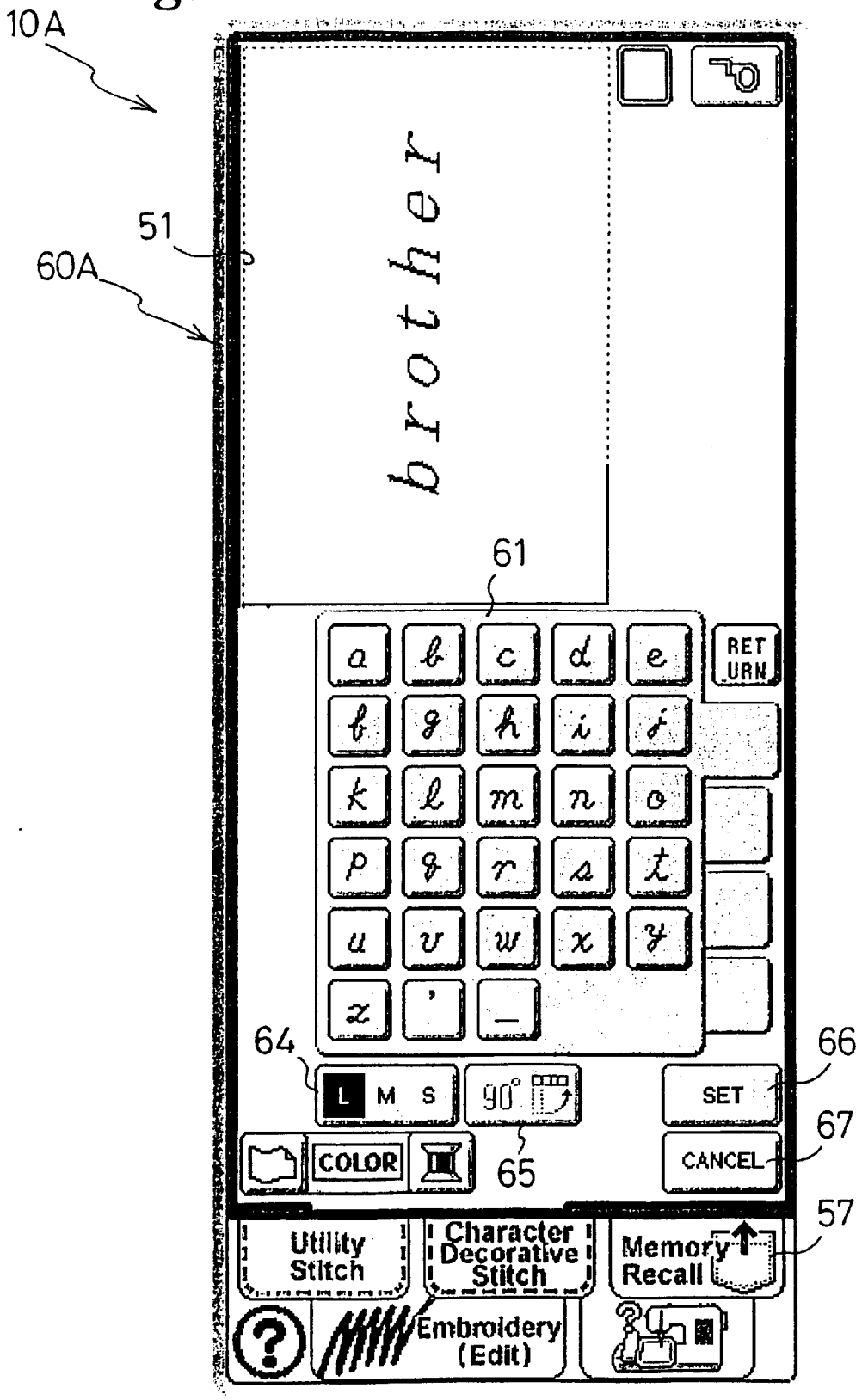
FIG. 19 is a character selection screen according to another exemplary embodiment of the invention.

As shown in FIG. 19, a liquid crystal display 10A which is longer in the portrait orientation than the LCD 10, can be provided so as to display the pattern display area 51 and the character pattern selection area 61 simultaneously without overlapping each other on the same screen (the character pattern selection screen 60A) of the LCD 10A. When a picture pattern is selected, the picture pattern selection area 81 can be displayed in the same position as the character pattern selection area 61.

Through the longer display 10A, the operator can see and grasp the layout of the pattern such as the size and the array orientation of the pattern without any interference with the embroidery pattern selection. The display 10A can display the size key (L/M/S) 64, the array key 65, the SET key 66, the CANCEL key 67, the Memory Recall key 57, and other function keys below the character pattern selection area 61 (or the picture pattern selection area 81).

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes maybe made without departing from the spirit and scope and of the invention.

What is claimed is:

1. A display apparatus for a sewing machine, comprising:

a display;

a pattern selection area controller that displays a pattern selection area on the display, the pattern selection area controller displaying at least one pattern on the pattern selection area;

a selection device that selects a pattern displayed on the pattern selection area;

a pattern display area controller that displays a pattern display area on the display, the pattern display area controller displaying the selected pattern in a correct user selected orientation on the pattern display area; and a display controller that controls the display to display at least a part of the pattern display area while the pattern selection area is displayed.

2. The display apparatus according to claim 1, further comprising an edit device that edits the selected pattern displayed on the pattern display area.

3. The display apparatus according to claim 1, wherein the realistic manner is related to at least one of pattern size, pattern orientation, and arrangement orientation.

4. The display apparatus according to claim 1, wherein the display comprises a touch key panel including at least one touch key, and the selection device comprises the at least one touch key.

5. The display apparatus according to claim 1, wherein the display controller controls the display to display the pattern selection area and the pattern display area without overlapping each other.

6. The display apparatus according to claim 1, wherein the display controller controls the display to display the pattern selection area overlapping a part of the pattern display area, and the pattern display area controller displays at least a portion of the selected pattern on an un-overlapped part of the pattern display area, where the pattern selection area is not overlapped.

7. The display apparatus according to claim 6, wherein when a character pattern is selected by the selection device, the whole character pattern can be displayed on the un-overlapped part of the pattern display area.

8. A display apparatus for a sewing machine, comprising:

a display;

a pattern selection area controller that displays a pattern selection area on the display, the pattern selection area controller displaying at least one pattern on the pattern selection area;

a selection device that selects a pattern displayed on the pattern selection area;

a pattern display area controller that displays a pattern display area on the display, the pattern display area controller displaying the selected pattern in a realistic manner on the pattern display area; and a display controller that controls the display to display at least a part of the pattern display area while the pattern selection area is displayed, wherein when selection of the pattern is completed, the display controller controls the display to cancel displaying the pattern selection area.

9. The display apparatus according to claim 8, wherein the pattern display area controller displays the selected pattern in a substantially center portion of the pattern display area.

10. The display apparatus according to claim 1, wherein the display controller controls the display to display information on a remaining part of the display except for the pattern selection area and the pattern display area.

11. A method for controlling a display apparatus of a sewing machine, comprising:

displaying a pattern selection area on a display, the pattern selection area displaying at least one pattern on the pattern selection area;

selecting a pattern displayed on the pattern selection area;

displaying a pattern display area on the display, the pattern display area displaying the selected pattern in a correct user selected orientation on the pattern display area; and displaying at least a part of the pattern display area while the pattern selection area is displayed.

12. The method of claim 11, further comprising editing the selected pattern on the pattern display area.

13. The method of claim 11, wherein the realistic manner is related to at least one of pattern size, pattern orientation, and arrangement orientation.

14. The method of claim 11, wherein the display comprises a touch key panel including at least one touch key, and selecting the pattern includes selecting a touch key.

15. The method of claim 11, wherein the pattern selection area and the pattern display area are displayed without overlapping each other.

16. The method of claim 11, wherein the pattern selection area is displayed overlapping a part of the pattern display area, and at least a portion of the selected pattern is displayed on an un-overlapped part of the pattern display area, where the pattern selection area is not overlapped.

17. The method of claim 16, wherein when a character pattern is selected, the whole character pattern can be displayed on the un-overlapped part of the pattern display area.

18. A method for controlling a display apparatus of a sewing machine, comprising:

displaying a pattern selection area on a display, the pattern selection area displaying at least one pattern on the pattern selection area;

selecting a pattern displayed on the pattern selection area;

displaying a pattern display area on the display, the pattern display area displaying the selected pattern in a realistic manner on the pattern display area;

displaying at least a part of the pattern display area while the pattern selection area is displayed; and cancelling displaying the pattern selection area when selection of the pattern is completed.

19. The method of claim 18, wherein the selected pattern is displayed in a substantially center portion of the pattern display area.

20. The method of claim 11, further comprising displaying information on a remaining part of the display except for the pattern selection area and the pattern display area.

21. A memory medium containing routines for controlling a display apparatus of a sewing machine, comprising:

a routine for displaying a pattern selection area on a display, the pattern selection area displaying at least one pattern on the pattern selection area;

a routine for selecting a pattern displayed on the pattern selection area;

a routine for displaying a pattern display area on the display, the pattern display area displaying the selected pattern in a correct user selected orientation on the pattern display area; and a routine for displaying at least a part of the pattern display area while the pattern selection area is displayed.

22. The memory medium of claim 21, further comprising a routine for editing the selected pattern on the pattern display area.

23. The memory medium of claim 21, wherein the realistic manner is related to at least one of pattern size, pattern orientation, and arrangement orientation.

24. The memory medium of claim 21, wherein the display comprises a touch key panel including at least one touch key, and the routine for selecting the pattern includes selecting a touch key.

25. The memory medium of claim 21, wherein the pattern selection area and the pattern display area are displayed without overlapping each other.

26. The memory medium of claim 21, wherein the pattern selection area is displayed overlapping a part of the pattern display area, and at least a portion of the selected pattern is displayed on an un-overlapped part of the pattern display area, where the pattern selection area is not overlapped.

27. The memory medium of claim 26, wherein when a character pattern is selected, the whole character pattern can be displayed on the un-overlapped part of the pattern display area.

28. A memory medium containing routines for controlling a display apparatus of a sewing machine, comprising:

a routine for displaying a pattern selection area on a display, the pattern selection area displaying at least one pattern on the pattern selection area;

a routine for selecting a pattern displayed on the pattern selection area;

a routine for displaying a pattern display area on the display, the pattern display area displaying the selected pattern in a realistic manner on the pattern display area;

a routine for displaying at least a part of the pattern display area while the pattern selection area is displayed; and a routine for cancelling displaying the pattern selection area when selection of the pattern is completed.

29. The memory medium of claim 28, wherein the selected pattern is displayed in a substantially center portion of the pattern display area.

30. The memory medium of claim 21, further comprising a routine for displaying information on a remaining part of the display except for the pattern selection area and the pattern display area.

* * * * *